US008554103B2

(12) United States Patent
Oomoto et al.

(10) Patent No.: US 8,554,103 B2
(45) Date of Patent: Oct. 8, 2013

(54) IMAGE FORMING APPARATUS

(75) Inventors: Noboru Oomoto, Toyokawa (JP); Shoichi Yoshikawa, Okazaki (JP); Shigeru Tashiro, Toyokawa (JP); Atsuhiko Shimoyama, Tahara (JP); Yoshiyuki Toso, Toyokawa (JP); Tou Matsunaga, Okazaki (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 303 days.

(21) Appl. No.: 12/964,934

(22) Filed: Dec. 10, 2010

(65) Prior Publication Data

US 2011/0142483 A1 Jun. 16, 2011

(30) Foreign Application Priority Data

Dec. 16, 2009 (JP) ..... 2009-285072

(51) Int. Cl.
*G03G 21/20* (2006.01)

(52) U.S. Cl.
USPC ..... 399/93

(58) Field of Classification Search
USPC ..... 399/93, 122
See application file for complete search history.

(56) References Cited

U.S. PATENT DOCUMENTS

| | | | |
|---|---|---|---|
| 3,914,046 | A | 10/1975 | Tanaka et al. |
| 5,390,006 | A | 2/1995 | Wakabayashi et al. |
| 6,137,983 | A | 10/2000 | Okabayashi et al. |
| 2009/0003900 | A1 | 1/2009 | Shimizu et al. |

FOREIGN PATENT DOCUMENTS

| | | | |
|---|---|---|---|
| JP | 3-186862 | A | 8/1991 |
| JP | 5-150605 | A | 6/1993 |
| JP | 2007-193059 | | 8/2007 |
| JP | 2008-009265 | | 1/2008 |
| JP | 2010-134133 | A | 6/2010 |

OTHER PUBLICATIONS

Machine translation of Fushiki (JP 06083226 A). Pub date Mar. 25, 1994.*
Machine translation of Ishii (JP 2007193059 A). Pub date Aug. 2, 2007.*
Machine translation of Kimura (JP 2010134133 A). Pub date Jun. 17, 2010.*
Machine translation of Umeda ( JP 2008009265 A). Pub date Jan. 7, 2008.*

(Continued)

*Primary Examiner* — Walter L Lindsay, Jr.
*Assistant Examiner* — Frederick Wenderoth
(74) *Attorney, Agent, or Firm* — Buchanan Ingersoll & Rooney PC

(57) ABSTRACT

An image forming apparatus includes a cylindrical or annular fixing member, an outer surface of which is brought into pressure contact with a conveyed sheet to fix an image onto the sheet; and a heating source for heating the fixing member to a specified target temperature. The fixing member includes a cylindrical or annular base material, a rubber layer with elasticity, and an outer layer for aiding release of the sheet. An end portion of the rubber layer and an end portion of the outer layer are each positioned inner than an end portion of the base material with respect to a width direction perpendicular to a circumferential direction on the base material. A filter member capable of trapping ultra fine particles generated from the rubber layer is provided on the base material in a position facing the end portion of the rubber layer along the circumferential direction.

16 Claims, 12 Drawing Sheets

(56) References Cited

OTHER PUBLICATIONS

Office Action (Preliminary Notice of Rejection) dated Nov. 22, 2011, issued in the corresponding Japanese Patent Application No. 2009-285072, and an English Translation thereof. (7 pages).

Office Action (Preliminary Notice of Rejection) dated May 15, 2012, issued in corresponding Japanese Patent Application No. 2012-010342, and an English Translation thereof. (4 pages).

Extended Search Report issued Jul. 13, 2011, in corresponding European Patent Application No. 10193636.7-2209.

Extended Search Report dated Nov. 20, 2012, issued in corresponding European Patent Application No. 12185858.3, and an English Translation thereof. (5 pages).

Extended Search Report dated Nov. 20, 2012, issued in corresponding European Patent Application No. 12185855.9, and an English Translation thereof. (5 pages).

* cited by examiner 300
301
303
L
T
T
L
301
T'
Le
T'
Le
301

IMAGE FORMING APPARATUS

This application is based on an application No. 2009-285072 filed in Japan on Dec. 16, 2009, the entire content of which is hereby incorporated by reference.

TECHNICAL FIELD

The present invention relates to an image forming apparatus, and more specifically to an electrophotographic image forming apparatus such as printers, copying machines and facsimile machines.

BACKGROUND ART

It is known for this kind of an electrophotographic image forming apparatus that several kinds of chemical substances are emitted during imaging operation. Typical chemical substances to be emitted (chemical emission) include ozone generated during charging of a photoconductor and toner powder dust generated during developing or fixing operation. Conventional solutions to the chemical emission include taking measures against the emission source of such chemical emission so as to decline the emission amount itself, and providing a filter to prevent emitted substances from being discharged outside from the apparatus. For example, in JP H5-150605 A, a divider plate is provided inside the apparatus to guide generated ozone to an ozonolysis device.

However, with a recent increase in awareness of global environmental conservation, ultra fine particles (with a particle size of 100 nm or less), which are substances different from ozone or toner powder dust, generated from electrophotographic image forming apparatuses have come to be seen as a problem. It has been unknown hitherto where such ultra fine particles are generated inside an image forming apparatus, and therefore it has been impossible to take effective measures for the problem. As a result, the ultra fine particles are considered to have caused contamination of the environment inside or around the apparatus.

As a result of the investigation conducted by the inventor of the present invention, it was found out that in an electrophotographic image forming apparatus, such ultra fine particles are mainly generated in a fixing device, more specifically in a rubber layer included in a fixing member (such as rollers and belts) which forms a nip section for fixing operation.

As shown in FIG. 15A, a general fixing member 300 includes three layers composed of a base material 301 made of a cylindrical core metal or an annular endless belt, a rubber layer 302 provided so as to cover the outer surface of the base material 301, and an outer layer 303 provided so as to cover the outer surface of the rubber layer 302. In this example, a heater 305 is provided in an internal space of the base material 301 for heating the fixing member 300 to a specified target temperature (a fixing temperature in the range of 180° C. to 200° C.). The rubber layer 302, which is made of a silicone rubber material, has heat tolerance to the fixing temperature and elasticity for allowing for the length of a nip section. The outer layer 303 is made of, for example, PFAs (tetrafluoro ethylene perfluoroalkyl vinyl ether copolymers) for aiding release of a sheet (recording material such as paper sheets) which passed the nip section. An end portion 302*e* of the rubber layer 302 and an end portion 303*e* of the outer layer 303 are both positioned inner than an end portion 301*e* of the base material 301 with respect to a direction along a central shaft C of the base material 301.

As a result of investigation conducted by the inventor of the present invention, it has been found out that as shown in FIG. 15B, when the base material 301, the rubber layer 302 and the like were heated with the heater 305 (reference sign H shows heat rays), siloxanes (designated by reference sign G) were generated in the form of ultra fine particles from the silicone rubber material which constitutes the rubber layer 302. Since the outer layer 303 made of PFAs and the like typically has a nature hard to transmit the ultra fine particles (gas barrier property), siloxanes G are emitted from the end portion 302*e* of the rubber layer 302. The emitted siloxanes G pollute the environment inside and around the image forming apparatus.

As a solution, simply covering and sealing the end portion 302*e* of the rubber layer 302 with the outer layer 303 may be contemplated. However, in the image forming apparatus, a fixing member is a component part having substantial increase and decrease in temperature. In the solution involving simple sealing, the rubber layer 302 and the outer layer 303 may be separated due to gas pressure of the ultra fine particles (e.g., siloxanes) generated from the rubber layer 302. If such a situation occurs, a performance of the fixing member and image forming apparatus will be degraded, leading to considerable reduction in their life span.

SUMMARY OF THE INVENTION

An image forming apparatus according to a first aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical or annular base material; a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, and wherein a filter member capable of trapping ultra fine particles generated from the rubber layer is provided on the base material in a position facing the end portion of the rubber layer along the circumferential direction.

An image forming apparatus according to a second aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical or annular base material; a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, the mage forming apparatus further comprising:

a duct provided around the base material in a position facing the end portion of the rubber layer along the circumferential direction, and having an inlet for taking in ultra fine particles generated from the end portion of the rubber layer;

an air flow generation section for generating an air current flowing from the inlet to an outlet of the duct; and a filter member provided inside the duct or in the outlet so as to be able to trap the ultra fine particles which ride on the air current and flow through the duct.

An image forming apparatus according to a third aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the sealing member includes a cylindrical base material, a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than the an end portion of the base material with respect to a width direction perpendicular to a circumferential direction on the base material, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material; and wherein a filter member capable of trapping ultra fine particles generated from the rubber layer is provided in a region of an internal space of the base material which corresponds to an outside of a plurality of the through holes with respect to the width direction.

An image forming apparatus according to a fourth aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical base material; a rubber layer provided so as to cover an outer surface of the base material and having elasticity; and an outer layer provided so as to cover an outer surface of the rubber layer for aiding release of the sheet, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material, the image forming apparatus further comprising:

a duct which is fittingly attached to an end portion of the base material and which has an inlet for taking in ultra fine particles generated from the rubber layer through the through holes and an internal space of the base material;

an air flow generation section for generating an air current flowing from the inlet to an outlet of the duct; and a filter member provided inside the duct or in the outlet so as to be able to trap the ultra fine particles which ride on the air current and flow through the duct.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 4A is a view showing one aspect of the vicinity of the fixing device included in the image forming apparatus as viewed from the direction perpendicular to a central shaft of the fixing roller, while

FIG. 6A is a view showing another aspect of the vicinity of the fixing device included in the image forming apparatus as viewed from the direction perpendicular to the central shaft of the fixing roller, while

FIG. 8A is a view showing another aspect of the vicinity of the fixing device included in the image forming apparatus as viewed from the direction perpendicular to the central shaft of the fixing roller, while

FIG. 9A is a view showing another aspect of the vicinity of the fixing device included in the image forming apparatus as viewed from the direction perpendicular to the central shaft of the fixing roller, while

FIG. 15A is a cross sectional view showing a general configuration of the fixing roller, while

DESCRIPTION OF EMBODIMENTS

Figure 1:
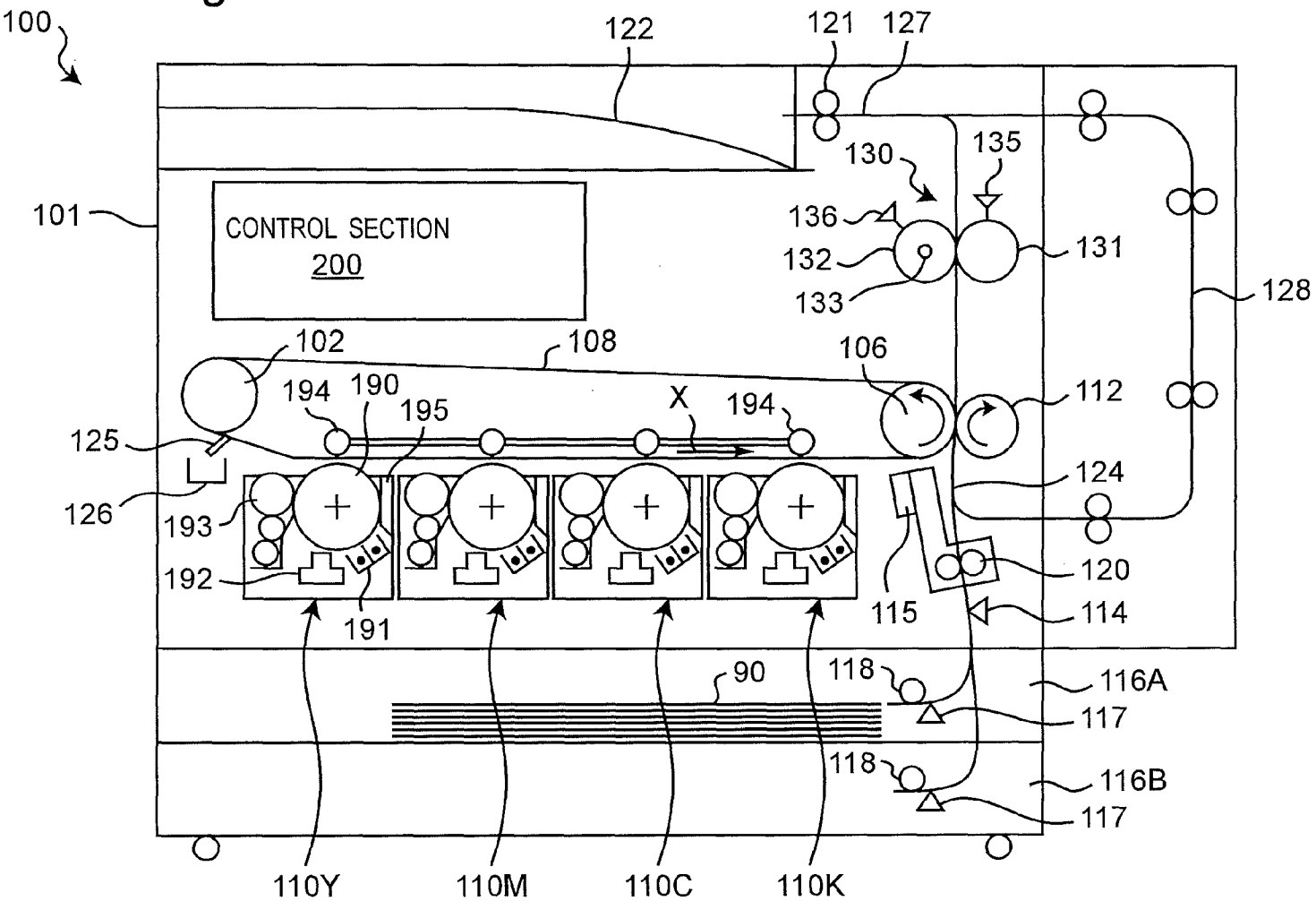
FIG. 1 is an overall configuration view showing an image forming apparatus in one embodiment of the invention.

FIG. 1 shows a schematic configuration of a color tandem-type image forming apparatus 100 in one embodiment of the invention. The image forming apparatus, which is a multi-functional machine having functions of a scanner, a copier, a printer and other apparatuses, is called MFT (Multi Function Peripheral).

The image forming apparatus 100 includes an intermediate transfer belt 108 as an annular intermediate transfer body provided generally in the center inside a main body casing 101, the intermediate transfer belt 108 being wound around two rollers 102, 106 and moving in the circumferential direction. One roller 102 out of two rollers 102 and 106 is placed on the left-hand side in the drawing, while the other roller 106 is placed on the right-hand side in the drawing. The intermediate transfer belt 108 is supported on these rollers 102, 106, and is rotated in an arrow X direction.

Imaging units 110Y, 110M, 110C and 110K as printing sections corresponding to respective color toners of yellow (Y), magenta (M), cyan (C) and black (K) are placed below the intermediate transfer belt 108 side by side in order from the left-hand side in the drawing.

The respective imaging units 110Y, 110M, 110C and 110K have completely similar configuration except for a difference in toner color that the respective units handle. More specifically, the yellow imaging unit 110Y for example is integrally composed of a photoconductor drum 190, a charging device 191, an exposure device 192, a developing device 193 for development with use of toner, and a cleaning device 195. A primary transfer roller 194 is provided in a position facing the photoconductor drum 190 across the intermediate transfer belt 108. At the time of image formation, the surface of the photoconductor drum 190 is first uniformly charged by the charging device 191, and then the surface of the photoconductor drum 190 is exposed by the exposure device 192 in response to an image signal inputted from an unshown external unit to form a latent image thereon. Next, the latent image on the surface of the photoconductor drum 190 is developed into a toner image by the developing device 193. This toner image is transferred onto the intermediate transfer belt 108 upon voltage application to between the photoconductor drum 190 and the primary transfer roller 194. The transfer residual toner on the surface of the photoconductor drum 190 is cleaned by the cleaning device 195.

As the intermediate transfer belt 108 moves in the arrow X direction, overlapped toner images of four colors are formed as inputted images on the intermediate transfer belt 108 by each of the imaging units 110Y, 110M, 110C and 110K.

Provided on the left-hand side of the intermediate transfer belt 108 are a cleaning device 125 for removing residual toner from the surface of the intermediate transfer belt 108 and a toner collecting box 126 for collecting the toner removed by the cleaning device 125. A secondary transfer roller 112 as a secondary transfer member is provided on the right-hand side of the intermediate transfer belt 108 across a conveying path 124 for paper sheets. A conveying roller 120 is provided at a position corresponding to the upstream side of the secondary transfer roller 112 on the conveying path 124. An optical concentration sensor 115 is provided as a toner concentration sensor for detecting toner patterns on the intermediate transfer belt 108.

A fixing device 130 is provided in the upper right part inside the main body casing 101 as a fixing section for fixing toner onto paper sheets. The fixing device 130 includes a heating roller 132 as a fixing member extending perpendicularly to the page of FIG. 1 and a pressure roller 131 as a pressure member. The heating roller 132 is heated to a specified target temperature (a fixing temperature in the range of 180° C. to 200° C. in this example) with a heater 133 as a heating source. The pressure roller 131 is biased toward the heating roller 132 with an unshown spring. Accordingly, the pressure roller 131 and the heating roller 132 form a nip section for fixation. As a paper sheet 90 carrying a toner image transferred thereon passes through the nip section, the toner image is fixed onto the paper sheet 90. The temperature of the pressure roller 131 and the heating roller 132 is detected by temperature sensors 135, 136 which are each constituted of thermistors in this example.

Paper cassettes 116A, 116B as paper feed ports for storing paper sheets 90 as printing media, on which output images should be formed, are provided in two levels in the lower part of the main body casing 101. The paper cassettes 116A, 116B are each equipped with a feed roller 118 for sending out paper sheets and a feeding sensor 117 for sensing the sent-out paper sheets. For easier understanding, the drawing shows the state in which the paper sheets 90 are stored only in the paper cassette 116A.

A control section 200 constituted of a CPU (Central Processing Unit) is provided in the main body casing 101 for controlling operation of the entire image forming apparatus.

At the time of image formation, paper sheets 90 are sent out one-by-one by the feed roller 118 from, for example, the paper cassette 116A to the conveying path 124 under control by the control section 200. The paper sheets 90 sent out to the conveying path 124 are sent into a toner transfer position between the intermediate transfer belt 108 and the secondary transfer roller 112 by the conveying roller 120 with the timing decided by a resist sensor 114. Meanwhile, an overlapped toner image of four colors is formed on the intermediate transfer belt 108 by each of the imaging units 110Y, 110M, 110C and 110K as mentioned before. The toner image of four colors on the intermediate transfer belt 108 is transferred onto a paper sheet 90, which was sent into the above-mentioned toner transfer position, by the secondary transfer roller 112. The paper sheet 90 with the toner image transferred thereon receives heat and pressure while being conveyed through the nip section formed between the pressure roller 131 and the heating roller 132 of the fixing device 130. As a result, the toner image is fixed onto the paper sheet 90. The paper sheet 90 with the toner image fixed thereto is then discharged by a paper ejecting roller 121 into a paper ejection tray section 122 provided on the upper surface of the main body casing 101 through a paper ejecting path 127. In this example, a switchback conveying path 128 is provided for resending paper sheets 90 into the toner transfer position in the case of double-side printing.

First Embodiment

Figure 2:
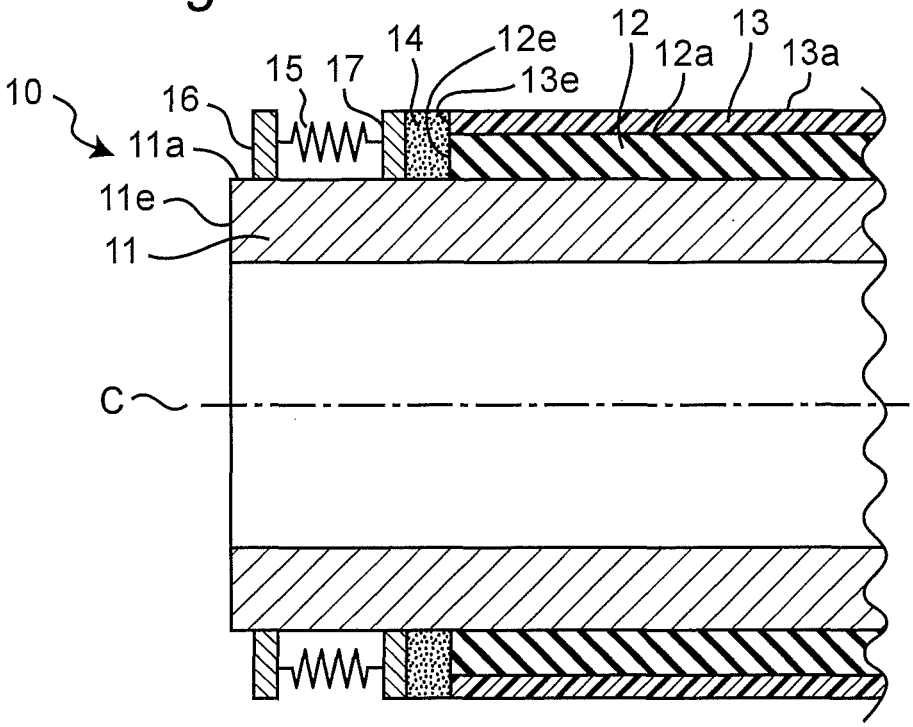
FIG. 2 is a cross sectional view showing one aspect of a fixing roller included in the image forming apparatus.

FIG. 2 shows a cross sectional configuration of one aspect (denoted by reference sign 10) of a fixing roller 132 as a fixing member included in the image forming apparatus 100.

The fixing roller 10 is composed of three layers including a core metal 11 as a cylindrical base material, a rubber layer 12 provided so as to cover an outer surface 11*a* of the core metal 11, and an outer layer 13 provided so as to cover an outer surface 12*a* of the rubber layer 12. A heater (equivalent to the heater 133 in FIG. 1) is provided in the internal space of the core metal 11 as a heating source for heating the fixing roller 10 to a specified target temperature (a fixing temperature in the range of 180° C. to 200° C. in this example).

The core metal 11 is made of a metallic material such as aluminum and iron. While the thickness of the core metal 11 is about 0.1 mm to 5 mm in this example, the thickness should preferably be about 0.1 mm to 1.5 mm in consideration of weight saving and warm-up time. The external diameter of the core metal 11 is set at about 10 mm to 50 mm in this example.

The rubber layer 12, which is made of a silicone rubber material, has heat tolerance to the fixing temperature and elasticity for allowing for the size of a region with which the paper sheet 90 is brought into pressure contact (length of the nip section). The thickness of the rubber layer 12, which should preferably be in the range of 0.05 mm to 2 mm, is about 0.2 mm to 0.4 mm in this example.

The outer layer 13, which is made of a fluorine-based resin such as PFA (tetrafluoroethylene perfluoro alkyl vinyl ether copolymer), PTFE (polytetrafluoroethylene) and ETFE (ethylene tetrafluoroethylene), has heat tolerance to the fixing temperature, releasability to aid release of the paper sheets 90 which passed the nip section, and a nature hard to transmit the ultra fine particles generated from the rubber layer 12 (gas barrier property). The thickness of the outer layer 13, which should preferably be in the range of 5 μm to 100 μm, is set at about 30 μm to 40 μm in this example.

An end portion 12*e* of the rubber layer 12 and an end portion 13*e* of the outer layer 13 are each placed in the same position inner than an end portion 11*e* of the core metal 11 with respect to the direction along the central shaft C of the core metal 11, i.e., a width direction of a paper sheet 90 which should be brought into pressure contact with the fixing roller 10.

A filter member 14 is provided on the core metal 11 in a position which is in direct contact with the end portion 12*e* of the rubber layer 12 and with the end portion 13*e* of the outer layer 13 along a circumferential direction. The filter member 14 is capable of trapping ultra fine particles, siloxanes in particular, generated from the rubber layer.

Examples of siloxanes include hexamethyldisiloxane (abbreviation: L2, molecular formula: $C_6H_{18}O_1Si_2$), hexamethylcyclotrisiloxane (abbreviation: D3, molecular formula: $C_6H_{18}O_3Si_3$), octamethyltrisiloxane (abbreviation: L3, molecular formula: $C_8H_{24}O_2Si_3$), octamethylcyclotetrasiloxane (abbreviation: D4, molecular formula: $C_8H_{24}O_4Si_4$), decamethyltetrasiloxane (abbreviation: L4, molecular formula: $C_{10}H_{30}O_3Si_4$), decamethylcyclopentasiloxane (abbreviation: D5, molecular formula: $C_{10}H_{30}O_5Si_5$), dodecamethylpentasiloxane (abbreviation: L5, molecular formula: $C_{12}H_{36}O_4Si_5$), and dodecamethylcyclohexasiloxane (abbreviation: D6, molecular formula: $C_{12}H_{36}O_6Si_6$).

As the filter member 14, commercial items such as Elitolon (registered trademark of Toyobo Co., Ltd.) that is an electrostatic filter made by Toyobo Co., Ltd., and micronAir (registered trademark of Freudenberg & Co.) made by Freudenberg & Co. Kommanditgesellschaft can be used. Filtering media having carbon or PTFE (polytetrafluoroethylene) as a main component may be used from a viewpoint of securing the heat tolerance of the filter member.

In this example of FIG. 2, two annular flanges 16, 17 are fitted onto the core metal 11 in a position closer to the end portion 11*e* of the core metal 11 than the filter member 14 with respect to the direction along the central shaft C. The flange 16 on the side far from the filter member 14 is fixed to the outer surface 11*a* of the core metal 11. The flange 17 on the side that is in contact with the filter member 14 is made movable with respect to the direction along the central shaft C. A bellows-shape spring member 15 is inserted in between the flanges 16 and 17. The filter member 14 is biased toward the end portion 12*e* of the rubber layer 12 and the end portion 13*e* of the outer layer 13 via the flange 17 by the spring member 15.

In the image forming apparatus having the fixing roller 10, the fixing roller 10 is heated by a heater 133 to a fixing temperature in the range of 180° C. to 200° C. A conveyed paper sheet 90 is brought into pressure contact with the outer surface 13*a* of the fixing roller 10 to fix an image on the paper sheet 90.

Once the fixing roller 10 is heated to the fixing temperature, ultra fine particles such as siloxanes (with a particle size of 100 nm or less) are generated from the rubber layer 12 of the fixing roller 10. Since the outer surface 12*a* of the rubber layer 12 is covered with the outer layer 13, the ultra fine particles are likely to be emitted from the end portion 12*e* of the rubber layer 12.

In this case, as mentioned before, a filter member 14 capable of trapping the ultra fine particles generated from the rubber layer 12 is provided on the core metal 11 of the fixing roller 10 in a position that is in direct contact with the end portion 12*e* of the rubber layer and with the end portion 13*e* of the outer layer 13. Therefore, the ultra fine particles which are likely to be emitted from the end portion 12*e* of the rubber layer 12 are trapped by the filter member 14. In this fixing roller 10, the filter member 14 is biased toward the end portion 12*e* of the rubber layer 12 and the end portion 13*e* of the outer layer 13 by the spring member 15. Therefore, the filter member 14 is in close contact with the end portion 12*e* of the rubber layer 12 and with the outer layer 13 irrespective of the aged deterioration of each member. Consequently, it is further ensured that the ultra fine particles which are likely to be emitted from the end portion 12*e* of the rubber layer 12 are trapped by the filter member 14. As a result, the image forming apparatus can prevent contamination of the environment inside and around the apparatus.

Although a higher pressure loss of the filter member 14 enhances trapping efficiency, if the pressure loss characteristics of the filter member 14 were higher than the pressure loss characteristics of outer layer 13, the ultra fine particles generated from the rubber layer 12 might pass through the outer layer 13 and might leak them out. Accordingly, the pressure loss characteristics of the filter member 14 should preferably be ½ or less of the pressure loss characteristics of the outer layer 13. In that case, the ultra fine particles generated from the rubber layer 12 are likely to pass through the filter member 14 rather than to transmit the outer layer 13. Therefore, it becomes easy to trap the ultra fine particles with the filter member 14. Moreover, it becomes possible to prevent separation between the rubber layer 12 and the outer layer 13 due to the gas pressure of the ultra fine particles generated from the rubber layer 12.

Second Embodiment

Figure 3:
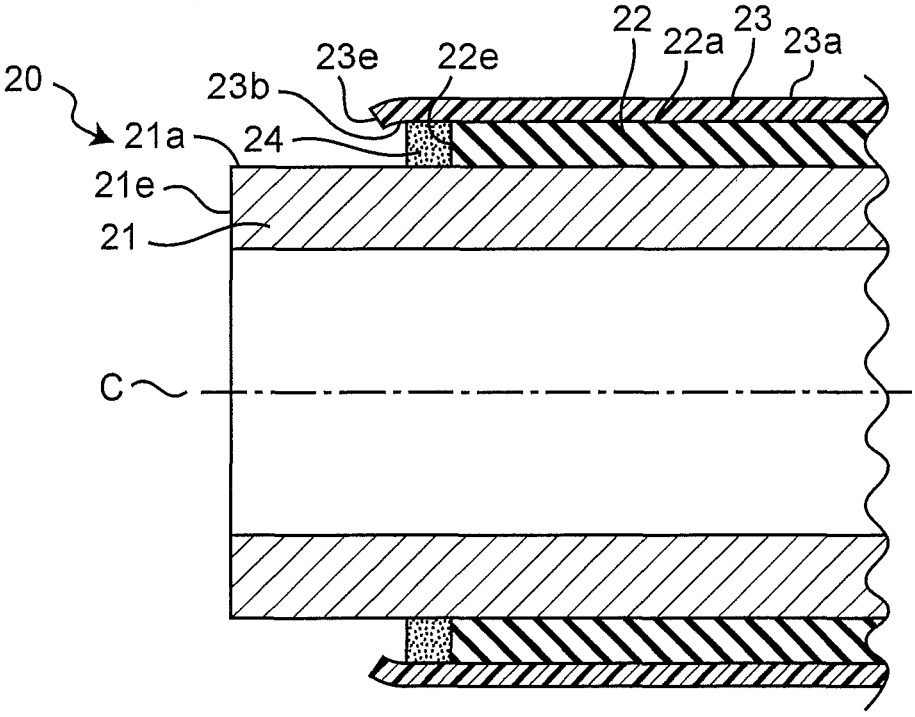
FIG. 3 is a cross sectional view showing another aspect of the fixing roller included in the image forming apparatus.

FIG. 3 shows a cross sectional configuration of another aspect (denoted by reference sign 20) of the fixing roller included in the image forming apparatus 100.

The fixing roller 20 is composed of three layers including a core metal 21 as a cylindrical base material, a rubber layer 22 provided so as to cover an outer surface 21*a* of the core metal 21, and an outer layer 23 provided so as to cover an outer surface 22*a* of the rubber layer 22. A heater (equivalent to the heater 133 in FIG. 1) is provided in the internal space of the core metal 21 as a heating source for heating the fixing roller 20 to a specified target temperature (a fixing temperature in the range of 180° C. to 200° C. in this example).

Materials, properties and thickness of the core metal 21, the rubber layer 22 and the outer layer 23 are identical to those of the core metal 11, the rubber layer and the outer layer 13 in the first embodiment, and therefore individual explanation thereabout will be omitted.

An end portion 22*e* of the rubber layer 22 and an end portion 23*e* of the outer layer 23 are each placed inner than an end portion 21*e* of the core metal 21 with respect to the direction along the central shaft C of the core metal 21, i.e., a width direction of a paper sheet 90 which should be brought into pressure contact with the fixing roller 20. The end portion 23*e* of the outer layer 23 is located in a position closer to the end portion 21*e* of the core metal 21 than the end portion 22*e* of the rubber layer 22 unlike the configuration in the first embodiment.

A filter member 24 is placed in between the outer surface 21*a* of the core metal 21 and an inner surface 23*b* of the outer layer 23. The filter member 24 faces the end portion 22*e* of the rubber layer 22 and is in direct contact with the end portion 22*e* of the rubber layer 22. It is to be noted that product names and functions of the filter member 24 are identical to those of the filter member 14 in the first embodiment.

In the image forming apparatus having the fixing roller 20, the fixing roller 20 is heated by a heater 133 to a fixing temperature in the range of 180° C. to 200° C. as in the first embodiment. A conveyed paper sheet 90 is brought into pressure contact with an outer surface 23*a* of the fixing roller 20 to fix an image on the paper sheet 90.

Once the fixing roller 20 is heated to the fixing temperature, ultra fine particles such as siloxanes (with a particle size of 100 nm or less) are generated from the rubber layer 22 of the fixing roller 20. Since the outer surface 22*a* of the rubber layer 22 is covered with the outer layer 23, the ultra fine particles are likely to be emitted from the end portion 22*e* of the rubber layer 22.

As mentioned above, the filter member 24 is placed in between the outer surface 21*a* of the core metal and the inner surface 23*b* of the outer layer 23. Therefore, the ultra fine particles which are likely to be emitted from the end portion 22*e* of the rubber layer 22 are trapped by the filter member 24. Moreover, the filter member 24 faces the end portion 22*e* of the rubber layer 22 and is in direct contact with the end portion 22*e* of the rubber layer 22. Consequently, it is further ensured that the ultra fine particles which are likely to be emitted from the end portion 22*e* of the rubber layer 22 are trapped by the filter member 24. As a result, the image forming apparatus can prevent contamination of the environment inside and around the apparatus.

Although a higher pressure loss of the filter member 24 enhances trapping efficiency, if the pressure loss characteristics of the filter member 24 were higher than the pressure loss characteristics of the outer layer 23, the ultra fine particles generated from the rubber layer 22 might pass through the outer layer 23 and might leak them out as in the first embodiment. Accordingly, the pressure loss characteristics of the filter member 24 should preferably be ½ or less of the pressure loss characteristics of the outer layer 23. In that case, ultra fine particles G generated from the rubber layer 22 are likely to pass through the filter member 24 rather than to transmit the outer layer 23. Therefore, it becomes easy to trap the ultra fine particles G with the filter member 24. Moreover, it becomes possible to prevent separation between the rubber layer 22 and the outer layer 23 due to the gas pressure of the ultra fine particles (such as siloxanes) generated from the rubber layer 22.

Third Embodiment

Figure 4B:
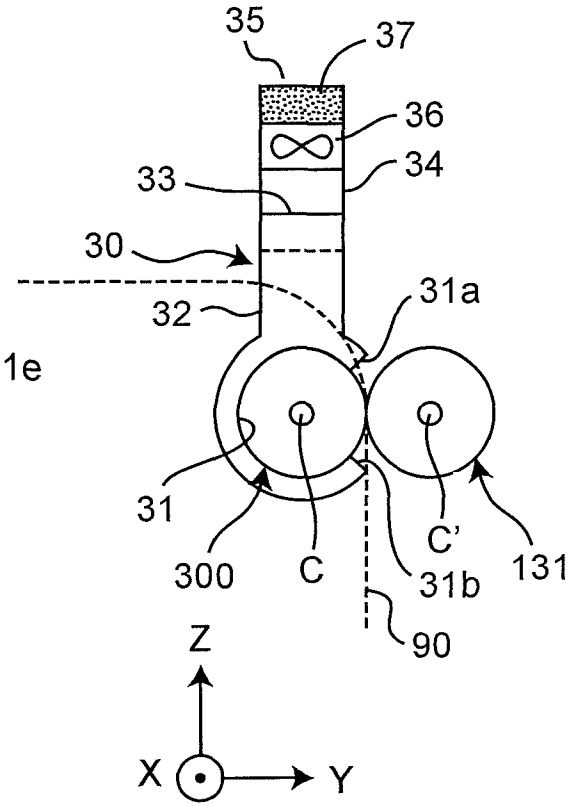
FIG. 4B is a view showing FIG. 4A as viewed from the right-hand side.
Figure 4A:
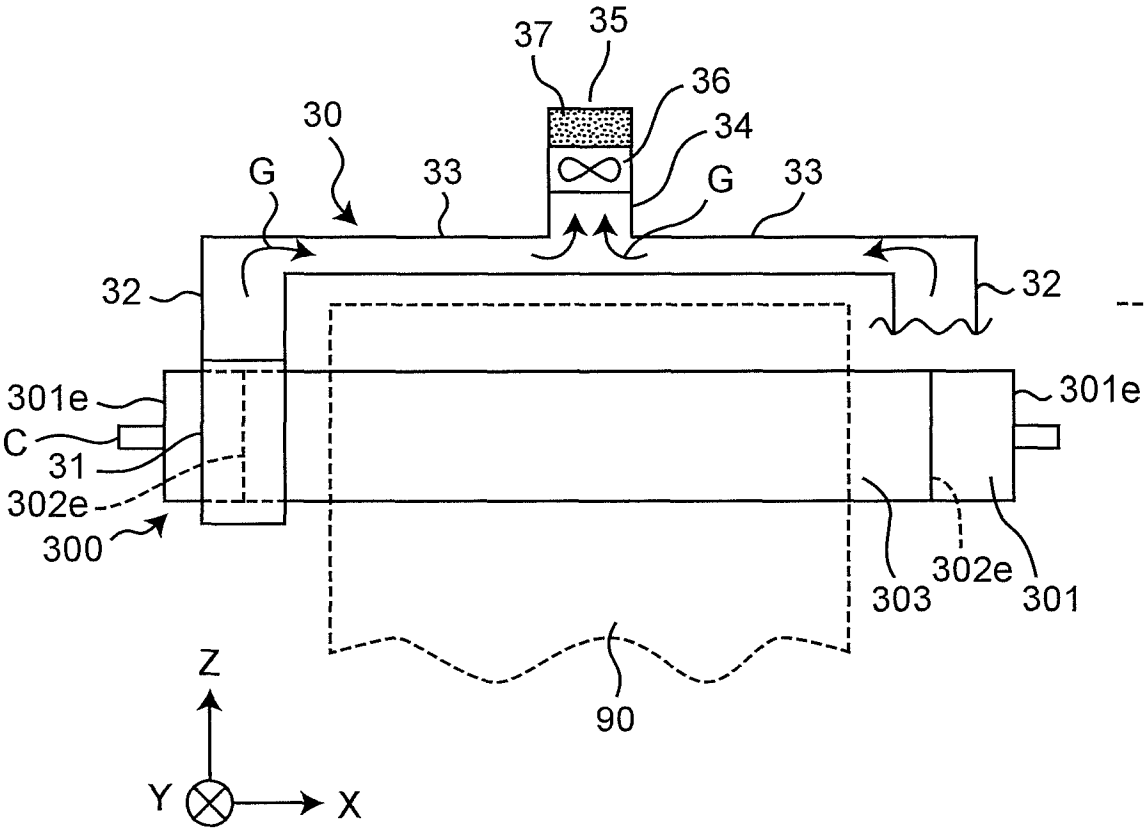

FIG. 4A shows one aspect of the vicinity of the fixing device included in the image forming apparatus 100 as viewed from a direction (—Y direction) perpendicular to the central shaft C of the fixing roller 300. FIG. 4B shows FIG. 4A as viewed from a right-hand direction (+X direction).

Figure 15B:
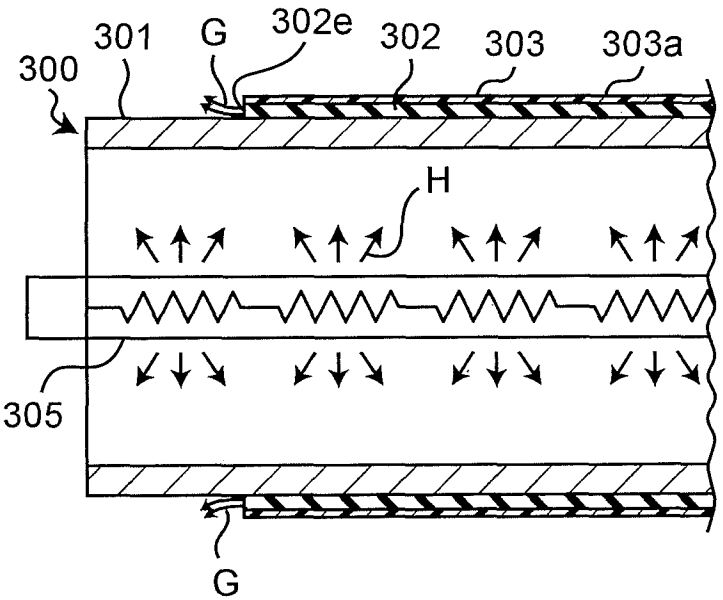
FIG. 15B is a view showing the state of siloxanes as ultra fine particles being emitted from an end portion of the rubber layer in the fixing roller.
Figure 15A:
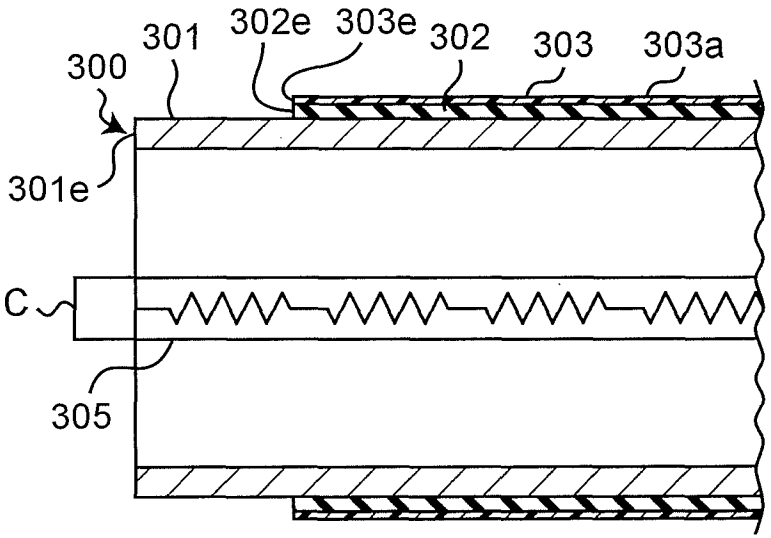

The fixing roller 300 itself shown in FIG. 4A and FIG. 4B (equivalent to the fixing roller 132 in FIG. 1) is similar to the general fixing roller shown in FIG. 15A. Materials, properties and thickness of a core metal 301, a rubber layer 302 and an outer layer 303, which constitute the fixing roller 300, are identical to those of the core metal 11, the rubber layer 12 and the outer layer 13 in the first embodiment, and therefore individual explanation thereabout will be omitted. A heater (equivalent to the heater 133 in FIG. 1) is provided in the internal space of the core metal 301 as a heating source for heating the fixing roller 300 to a specified target temperature (a fixing temperature in the range of 180° C. to 200° C. in this example).

A pressure roller 131 as a pressure member has a cylindrical outline (central shaft C') with a length generally the same as the length of the fixing roller 300. The pressure roller 131 has three-layer structure composed of a core metal, a middle layer and an outer layer similar to the fixing roller 300 in this example. Materials, properties and thickness of the core metal, the middle layer and the outer layer, which constitute the pressure roller 131 in this example, are similar to those of the fixing roller 300, and therefore individual explanation thereabout will be omitted.

In this embodiment, a duct 30 supported and fixed onto the main body casing 101 via an unshown frame is provided in the vicinity of the fixing roller 300. The duct 30 may be made of any one of resin materials having heat tolerance to the fixing temperature or metallic materials such as aluminum and iron.

As clearly shown in FIG. 4A, the duct 30 has a pair of inlets 31, 31 (FIG. 4A shows only the left-hand side inlet 31) provided around the core metal 301 in a position facing the end portion 302*e* of the rubber layer 302 along the circumferential direction, a pair of first vertical sections 32, 32 each communicating with the upper parts of the inlets 31, 31 and extending upward in a vertical direction (direction Z) from the upper parts of the inlets 31, 31, a pair of horizontal sections 33, 33 each communicating with the upper parts of the first vertical sections 32, 32, extending in a horizontal direction (direction X) from the upper parts of the first vertical sections 32, 32, and joining together in a spot corresponding to the central section of the fixing roller 300, and a second vertical section 34 communicating with the joining spot of these horizontal sections 33, 33 and extending upward in the vertical direction (direction Z) from the joining spot. The upper part of the second vertical part 34 constitutes an outlet 35 of the duct 30.

As clearly shown in FIG. 4B, the inlet 31 of the duct 30 surrounds generally all the outer circumferences of the fixing roller 300 except a portion abutting on the pressure roller 131. End faces (upper and lower end faces) 31*a*, 31*b* of the inlet 31 with respect to the circumferential direction are closed with a slight clearance present between the end faces 31*a*, 31*b* and the outer surface of the fixing roller 300.

Figure 5:
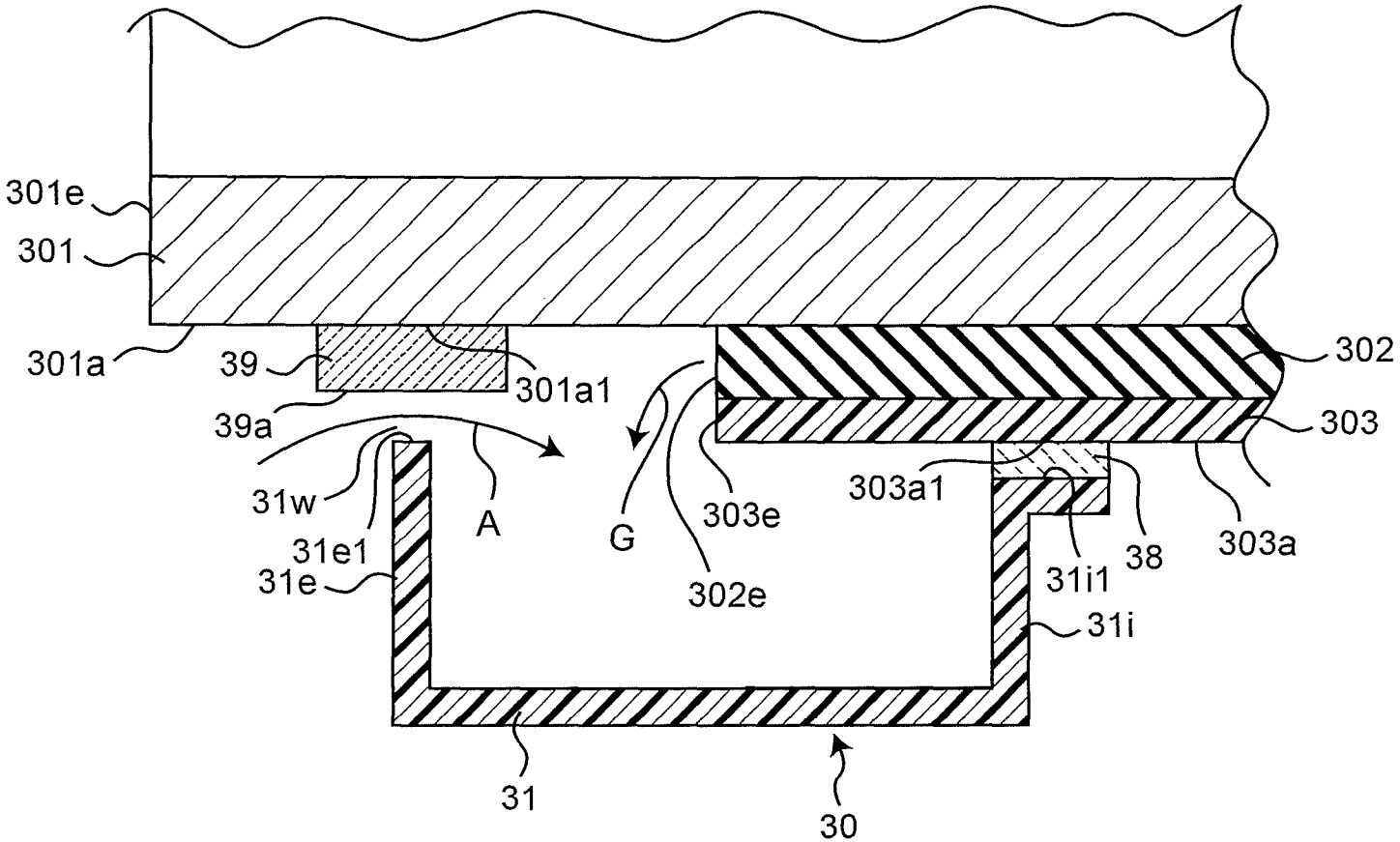
FIG. 5 is a cross sectional view showing the vicinity of an inlet of a duct shown in FIG. 4A and FIG. 4B.

In the cross section along the central shaft C of the fixing roller 300 as seen in FIG. 5, the inlet 31 of the duct 30 includes a first sidewall 31*e* positioned closer to an end portion 301*e* of the core metal 301 than an end portion 302*e* of the rubber layer 302, and a second sidewall 31*i* positioned farther from the end portion 301*e* of the core metal 301 than the end portion 302*e* of the rubber layer 302.

A sleeve 39 with heat insulation properties is put in close contact with a first sidewall facing section 301*a*1 of an outer surface 301*a* of the core metal 301 which faces the first sidewall 31*e* of the duct 30. An inner peripheral edge 31*e*1 of the first sidewall 31*e* of the duct 30 is distanced from an outer surface 39*a* of the sleeve 39.

A sealing member 38 having heat insulation properties and elasticity is mounted on an inner peripheral edge 31*i*1 of the second sidewall 31*i*. The inner peripheral edge 31*i*1 of the second sidewall 31*i* is in contact with a second sidewall facing section 303*a*1 on an outer surface 303*a* of the outer layer 303 via the sealing member 38. Since the outer layer 303 has releasability, the second sidewall facing section 303*a*1 of the outer layer 303 smoothly slides against the sealing member 38 when the fixing roller 300 rotates around the central shaft C during operation. Moreover, a buffer effect by the sealing member 38 prevents the inner peripheral edge 31*i*1 of the second sidewall 31*i* from coming into direct contact with the outer surface 303*a* of the outer layer 303 and causing damages thereby.

As shown in FIG. 4A and FIG. 4B, a filter member capable of trapping ultra fine particles G generated from (the end portion 302*e* of) the rubber layer 302 of the fixing roller 300 is provided in a portion inside the second vertical section 34 of the duct 30 which faces the outlet 35. It is to be noted that product names and functions of the filter member 37 are identical to those of the filter member 14 in the first embodiment.

An exhaust fan 36 as an air flow generation section is provided in a portion inside the second vertical section 34 of the duct 30 which corresponds to the upstream of the filter member 37. The exhaust fan 36 can ensure generation of an air current flowing from the inlet 31 to the outlet 35 of the duct 30.

In the image forming apparatus having such configuration, the fixing roller 300 is heated by a heater 133 to a fixing temperature in the range of 180° C. to 200° C. A conveyed paper sheet 90 is brought into pressure contact with the outer surface 303*a* of the fixing roller 300 to fix an image on the paper sheet 90.

Once the fixing roller 300 is heated to the fixing temperature, ultra fine particles G such as siloxanes (with a particle size of 100 nm or less) are generated from the rubber layer 302 of the fixing roller 300. Since the outer surface 302*a* of the rubber layer 302 is covered with the outer layer 303, the ultra fine particles G are likely to be emitted from the end portion 302*e* of the rubber layer 302.

In this image forming apparatus, the ultra fine particles G which are likely to be emitted from the end portion 302*e* of the rubber layer 302 are taken into the duct 30 through the inlet 31 provided around the core metal 301 in a position facing the end portion 302*e* of the rubber layer 302 along the circumferential direction. The ultra fine particles G taken into the duct 30 ride on the air current generated by the exhaust fan 36 and flow from the inlet 31 to the outlet 35 of the duct 30 through the first vertical section 32, the horizontal section 33 and the second vertical section 34 of the duct 30. The ultra fine particles G flowing through the duct 30 are then trapped by the filter member 37 provided in a portion facing the outlet 35 of the duct 30. As a result, the image forming apparatus can prevent contamination of the environment inside and around the apparatus.

In this image forming apparatus, as shown in FIG. 5, the inner peripheral edge 31*e*1 of the first sidewall, which constitutes the inlet 31 of the duct 30, is distanced from the outer surface 39*a* of the sleeve 39 (and therefore from the outer surface 301*a* of the core metal 301). Therefore, air near the inlet of the duct can flow into the duct 30 through a clearance 31*w* between the outer surface 39*a* of the sleeve 39 and the inner peripheral edge 31*e*1 of the first sidewall 31*e*. As a result, the exhaust fan 36 can easily generate an air current A flowing from the inlet 31 to the outlet 35 of the duct 30.

Moreover, the air A flowing into the duct 30 shown in FIG. 5 tends to take away the heat of the first sidewall facing section 301*a*1 on the outer surface 301*a* of the core metal 30, leading to temperature decrease in the first sidewall facing section 301*a*1. In this image forming apparatus, the first sidewall facing section 301*a*1 is covered with the sleeve 39 having heat insulation properties. Therefore, it becomes possible to prevent the temperature of the first sidewall facing section 301*a*1 from decreasing.

The inner peripheral edge 31*i*1 of the second sidewall 31*i* constituting the inlet 31 of the duct 30 is in contact with the second sidewall facing section 303*a*1 on the outer surface 303*a* of the outer layer 303 via the sealing member 38. Therefore, air near the inlet 31 of the duct 30 does not flow into the duct 30 from the second sidewall 31*i* side opposite to the first sidewall 31*e*. As a result, it becomes possible to effectively prevent temperature decrease in a region of the fixing roller 300 (existing in a region corresponding to the rubber layer 302) with which a paper sheet 90 (shown in FIG. 4A) is brought into pressure contact.

The duct 30 is connected from the inlet 31 to the outlet 35 of the duct 30 through the first vertical section 32, the horizontal section 33 and the second vertical section 34. In short, the duct 30 substantially extends upward from the inlet 31 to the outlet 35. Therefore, in this image forming apparatus, it becomes possible to use an ascending air current generated by the fixing roller 300 heated to the fixing temperature as an air flow generation section. Accordingly, as compared with the case where an ascending air current is not used, the rotational speed of the exhaust fan 36 can be kept to the low level. This makes it possible to more effectively prevent temperature decrease in the fixing roller 300 due to an inflow of the air A near the inlet 31 of the duct 30.

Moreover, the gas pressure of the ultra fine particles G (such as siloxanes) generated from the rubber layer 302 is released through the filter member 37. Therefore, it becomes possible to prevent separation between the rubber layer 302 and the outer layer 303.

It is to be noted that the clearance 31*w* between the outer surface 39*a* of the sleeve 39 and the inner peripheral edge 31*e*1 of the first sidewall 31*e* may be provided not over the entire region of the first sidewall 31*e* but only in a portion of the first sidewalls 31*e* (e.g., the lowermost part) with respect to the circumferential direction.

The filter member 37 may be provided inside the duct 30 instead of a portion facing the outlet 35 of the duct 30.

Fourth Embodiment

Figure 6A:
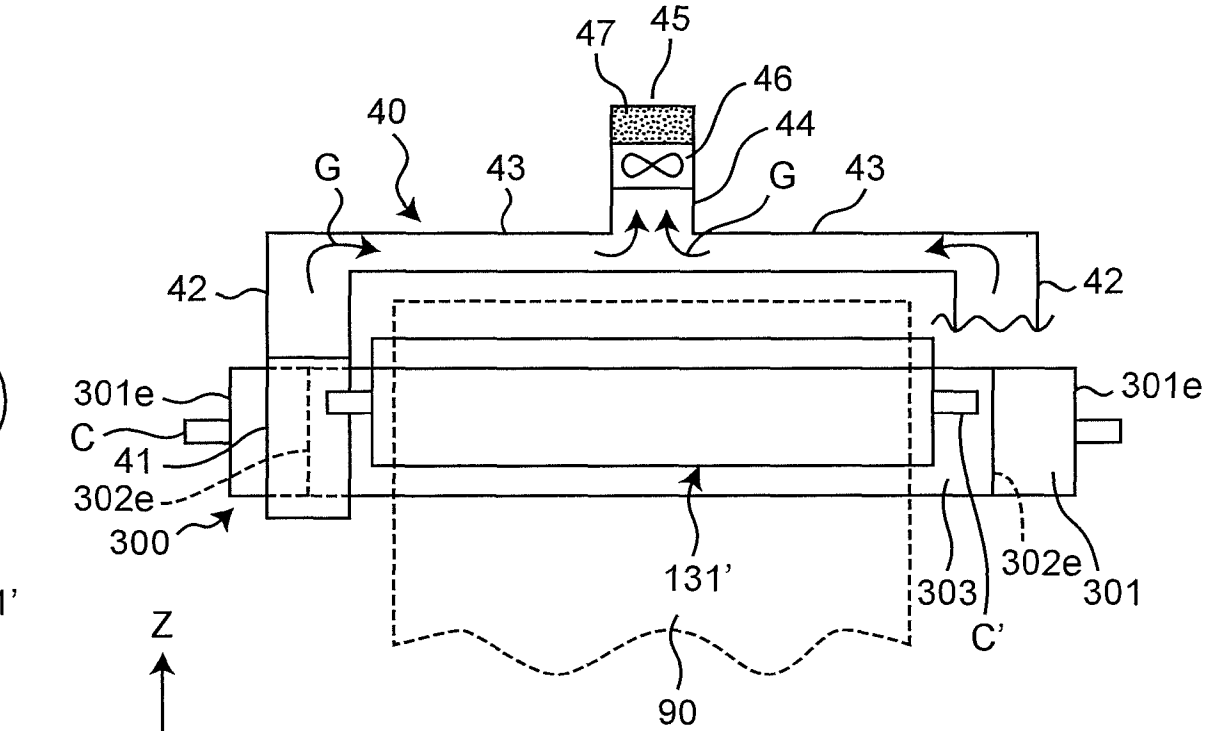
Figure 6B:
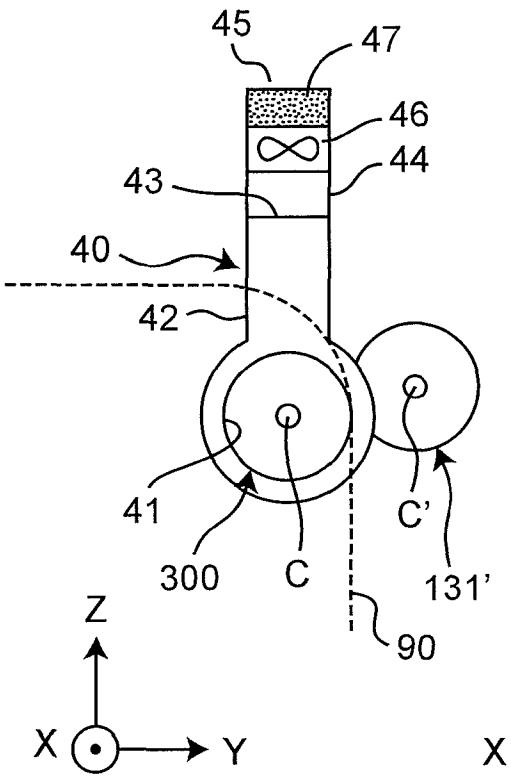
FIG. 6B is a view showing FIG. 6A as viewed from the left-hand side.

FIG. 6A shows another aspect of the vicinity of the fixing device included in the image forming apparatus 100 as viewed from a direction (+Y direction) perpendicular to the central shaft C of the fixing roller 300. FIG. 6B shows FIG. 6A as viewed from a left-hand side direction (+X direction).

The fixing roller 300 itself shown in FIG. 6A and FIG. 6B (equivalent to the fixing roller 132 in FIG. 1) is similar to the general fixing roller shown in FIG. 15A as in the third embodiment. Materials, properties and thickness of a core metal 301, a rubber layer 302 and an outer layer 303, which constitute the fixing roller 300, are identical to those of the core metal 11, the rubber layer 12 and the outer layer 13 in the first embodiment, and therefore individual explanation thereabout will be omitted. A heater (equivalent to the heater 133 in FIG. 1) is provided in the internal space of the core metal 301 as a heating source for heating the fixing roller 300 to a specified target temperature (a fixing temperature in the range of 180° C. to 200° C. in this example).

As shown in FIG. 6A, a pressure roller 131' as a pressure member has a cylindrical outline (central shaft C') with a length smaller the length of the fixing roller 300. More specifically, with respect to the direction (direction X) along the central shaft C of the fixing roller 300, the pressure roller 131' is larger in size than a paper sheet 90 (shown in FIG. 6A) and smaller in size than the rubber layer 302 and the outer layer 303. The pressure roller 131' has three-layer structure composed of a core metal, a middle layer and an outer layer similar to that of the fixing roller 300 in this example. Materials, properties and thickness of the core metal, the middle layer and the outer layer, which constitute the pressure roller 131', are similar to those of the fixing roller 300 in this example, and therefore individual explanation thereabout will be omitted.

In this embodiment, a duct 40 supported and fixed onto the main body casing 101 via an unshown frame is provided in the vicinity of the fixing roller 300. The duct 40 may be made any one of resin materials having heat tolerance to the fixing temperature or metallic materials such as aluminum and iron.

The duct 40 has a pair of inlets 41, 41 (FIG. 6A shows only the left-hand side inlet 41) provided around the core metal 301 in a position facing the end portion 302*e* of the rubber layer 302 along the circumferential direction, a pair of first vertical sections 42, 42 each communicating with the upper parts of the inlets 41, 41 and extending upward in a vertical direction (direction Z) from the upper parts of the inlets 41, 41, a pair of horizontal sections 43, 43 each communicating with the upper parts of the first vertical sections 42, 42, extending in a horizontal direction (direction X) from the upper parts of the first vertical sections 42, 42, and joining together in a spot corresponding to the central section of the fixing roller 300, and a second vertical section 44 communicating with the joining spot of these horizontal sections 43, 43 and extending upward in the vertical direction (direction Z) from the joining spot. The upper part of the second vertical part 44 constitutes an outlet 45 of the duct 40.

As clearly shown in FIG. 6B, the inlet 41 of the duct 40 surrounds and covers all circumferences of the end portion 302*e* of the rubber layer 302 (and the end portion 303*e* of the outer layer 303) of the fixing roller 300. The present embodiment is different from the third embodiment in this point.

In the cross section along the central shaft C of the fixing roller 300, the configuration in the vicinity of the inlet 41 of the duct 40 in this embodiment, i.e., the relation between the fixing roller 300 and a first sidewall and a second sidewall of the inlet 41, is completely similar to the configuration in the vicinity of the inlet 31 of the duct 30 in the third embodiment shown in FIG. 5.

As shown in FIG. 6A and FIG. 6B, a filter member capable of trapping ultra fine particles G generated from (the end portion 302*e* of) the rubber layer 302 of the fixing roller 300 is provided in a portion inside the second vertical section 44 of the duct 40 which faces the outlet 45. It is to be noted that product names and functions of the filter member 47 are identical to those of the filter member 14 in the first embodiment.

An exhaust fan 46 as an air flow generation section is provided in a portion inside the second vertical section 44 of the duct 40 which corresponds to the upstream of the filter member 47. The exhaust fan 46 can ensure generation of an air current flowing from the inlet 41 to the outlet 45 of the duct 40.

In this image forming apparatus, once the fixing roller 300 is heated to the fixing temperature during operation, ultra fine particles G such as siloxanes (with a particle size of 100 nm or less) are generated from the rubber layer 302 of the fixing roller 300. Since the outer surface 302*a* of the rubber layer 302 is covered with the outer layer 303, the ultra fine particles G are likely to be emitted from the end portion 302*e* of the rubber layer 302. The ultra fine particles G which are likely to be emitted from the end portion 302*e* of the rubber layer 302 are taken into the duct 40 through the inlet 41 provided around the core metal 301 in a position facing the end portion 302*e* of the rubber layer 302 along the circumferential direction. The ultra fine particles G taken into the duct 40 ride on the air current generated by the exhaust fan 46 and flow from the inlet 41 to the outlet 45 of the duct 40 through the first vertical section 42, the horizontal section 43 and the second vertical section of the duct 40. The ultra fine particles G flowing through the duct 40 are trapped by the filter member 47 provided in a portion facing the outlet 45 of the duct 40. As a result, the image forming apparatus can prevent contamination of the environment inside and around the apparatus.

In this image forming apparatus, the inlet 41 of the duct 40 covers all circumferences of the end portion 302*e* of the rubber layer 302 (and the end portion 303*e* of the outer layer 303), so that the ultra fine particles emitted from the end portion 302*e* of the rubber layer 302 of the fixing roller 300 can reliably be taken into the duct 40 through the inlet 41.

Fifth Embodiment

Figure 7:
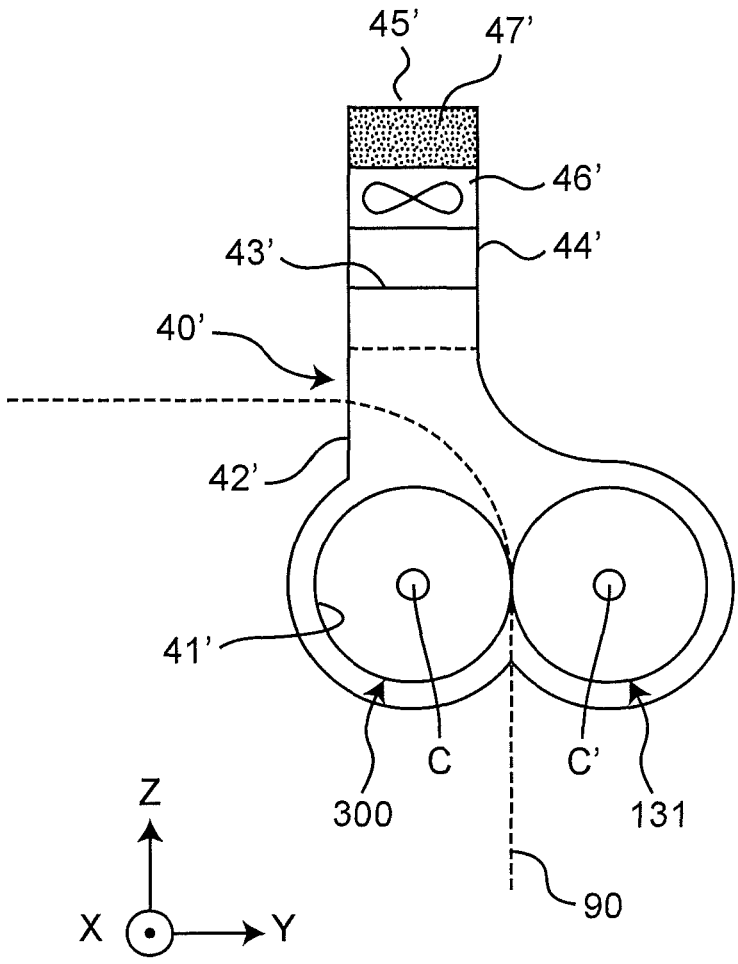
FIG. 7 is a view showing another aspect of the vicinity of the fixing device included in the image forming apparatus as viewed from the direction along the central shaft of the fixing roller.

FIG. 7 shows another aspect of the vicinity of the fixing device included in the image forming apparatus 100 as viewed from a direction (+X direction) perpendicular to the central shaft C of the fixing roller 300.

The fixing roller 300 itself shown in FIG. 7 (equivalent to the fixing roller 132 in FIG. 1) is similar to the general fixing roller shown in FIG. 15A as in the third embodiment. Materials, properties and thickness of a core metal 301, a rubber layer 302 and an outer layer 303, which constitute the fixing roller 300, are identical to those of the core metal 11, the rubber layer 12 and the outer layer 13 in the first embodiment, and therefore individual explanation thereabout will be omitted. A heater (equivalent to the heater 133 in FIG. 1) is provided in the internal space of the core metal 301 as a heating source for heating the fixing roller 300 to a specified target temperature (a fixing temperature in the range of 180° C. to 200° C. in this example).

A pressure roller 131 as a pressure member has a cylindrical outline (central shaft C') with a length generally the same as the length of the fixing roller 300 as in the third embodiment. More specifically, the pressure roller 131 is substantially equal in size to the fixing roller 300 with respect to the direction (direction X) along the central shaft C of the fixing roller 300. The pressure roller 131 has three-layer structure composed of a core metal, a middle layer and an outer layer similar to the fixing roller 300 in this example. Materials, properties and thickness of the core metal, the middle layer and the outer layer, which constitute the pressure roller 131, are similar to those of the fixing roller 300 in this example, and therefore individual explanation thereabout will be omitted.

In this embodiment, a duct 40' supported and fixed onto the main body casing 101 via an unshown frame is provided in the vicinity of the fixing roller 300. The duct 40' may be made of any one of resin materials having heat tolerance to the fixing temperature or metallic materials such as aluminum and iron.

As with the duct 40 shown in FIG. 6A and FIG. 6B, the duct 40' has a pair of inlets 41', 41' (FIG. 7 shows only the inlet 41' on the front side) provided around the core metal 301 in a position facing the end portion 302*e* of the rubber layer 302 along the circumferential direction, a pair of first vertical sections 42', 42' each communicating with the upper parts of the inlets 41', 41' and extending upward in a vertical direction (direction Z) from the upper parts of the inlets 41', 41' (FIG. 7 shows only the first vertical section 42 on the front side), a pair of horizontal sections 43', 43' each communicating with the upper parts of the first vertical sections 42', 42', extending in a horizontal direction (direction X) from the upper parts of the first vertical sections 42', 42', and joining together in a spot corresponding to the central section of the fixing roller 300 (FIG. 7 shows only the horizontal section 43' on the front side), and a second vertical section 44' communicating with the joining spot of these horizontal sections 43', 43' and extending upward in the vertical direction (direction Z) from the joining spot. The upper part of the second vertical part 44 constitutes an outlet 45' of the duct 40'.

As clearly shown in FIG. 7, the inlet 41' of the duct 40' collectively surrounds and covers all circumferences of the end portion 302*e* of the rubber layer 302 (and the end portion 303*e* of the outer layer 303) in the fixing roller 300 and a portion of the pressure roller 131 corresponding to the end portion 302*e* of the rubber layer 302. The present embodiment is different from the third embodiment in this point.

In the cross section along the central shaft C of the fixing roller 300, the configuration in the vicinity of the inlet 41' of the duct 40' in this embodiment, i.e., the relation between the fixing roller 300 and a first sidewall and a second sidewall of the inlet 41', is completely similar to the configuration in the vicinity of the inlet 31 of the duct 30 in the third embodiment shown in FIG. 5. Accordingly, detailed explanation thereabout will be omitted.

As shown in FIG. 7, a filter member 47' capable of trapping ultra fine particles G generated from (the end portion 302*e* of) the rubber layer 302 of the fixing roller 300 is provided in a portion inside the second vertical section 44' of the duct 40' which faces the outlet. It is to be noted that product names and functions of the filter member 47' are identical to those of the filter member 14 in the first embodiment.

An exhaust fan 46' as an air flow generation section is provided in a portion inside the second vertical section 44' of the duct 40' which corresponds to the upstream of the filter member 47'. The exhaust fan 46' can ensure generation of an air current flowing from the inlet 41' to the outlet 45' of the duct 40'.

In this image forming apparatus, once the fixing roller 300 is heated to the fixing temperature during operation, ultra fine particles G such as siloxanes (with a particle size of 100 nm or less) are generated from the rubber layer 302 of the fixing roller 300. Since the outer surface 302*a* of the rubber layer 302 is covered with the outer layer 303, the ultra fine particles G are likely to be emitted from the end portion 302*e* of the rubber layer 302. The ultra fine particles G which are likely to be emitted from the end portion 302*e* of the rubber layer 302 are taken into the duct 40' through the inlet 41' provided around the core metal 301 in a position facing the end portion 302*e* of the rubber layer 302 along the circumferential direction. The ultra fine particles G taken into the duct 40' ride on the air current generated by the exhaust fan 46' and flow from the inlet 41' to the outlet 45' of the duct 40' through the first vertical section 42', the horizontal section 43' and the second vertical section 44' of the duct 40'. The ultra fine particles G flowing through the duct 40' are trapped by the filter member 47' provided in a portion facing the outlet 45' of the duct 40'. As a result, the image forming apparatus can prevent contamination of the environment inside and around the apparatus.

In the image forming apparatus, the inlet 41' of the duct 40' collectively surrounds and covers all circumferences of the end portion 302*e* of the rubber layer 302 (and the end portion 303*e* of the outer layer 303) in the fixing roller 300 and a portion of the pressure roller 131 corresponding to the end portion 302*e* of the rubber layer 302. Therefore, not only the ultra fine particles emitted from the end portion 302*e* of the rubber layer 302 in the fixing roller 300 but also the ultra fine particles emitted from the end portion of the rubber layer in the pressure roller 131 can reliably be taken into the duct 40' through the inlet 41'.

Although in the third to fifth embodiments, the exhaust fans 36, 46, 46' are each placed in a portion inside the ducts 30, 40, 40' which corresponds to the upstream of the filter members 37, 47, 47', the present invention is not limited to this configuration. In consideration of the pressure loss of the filter members 37, 47, 47' and the ascending air current generated due to the temperature rise in the fixing roller, the exhaust fans 36, 46, 46' may be placed on the downstream of the filter members 37, 47, 47'.

Sixth Embodiment

Figure 8A:
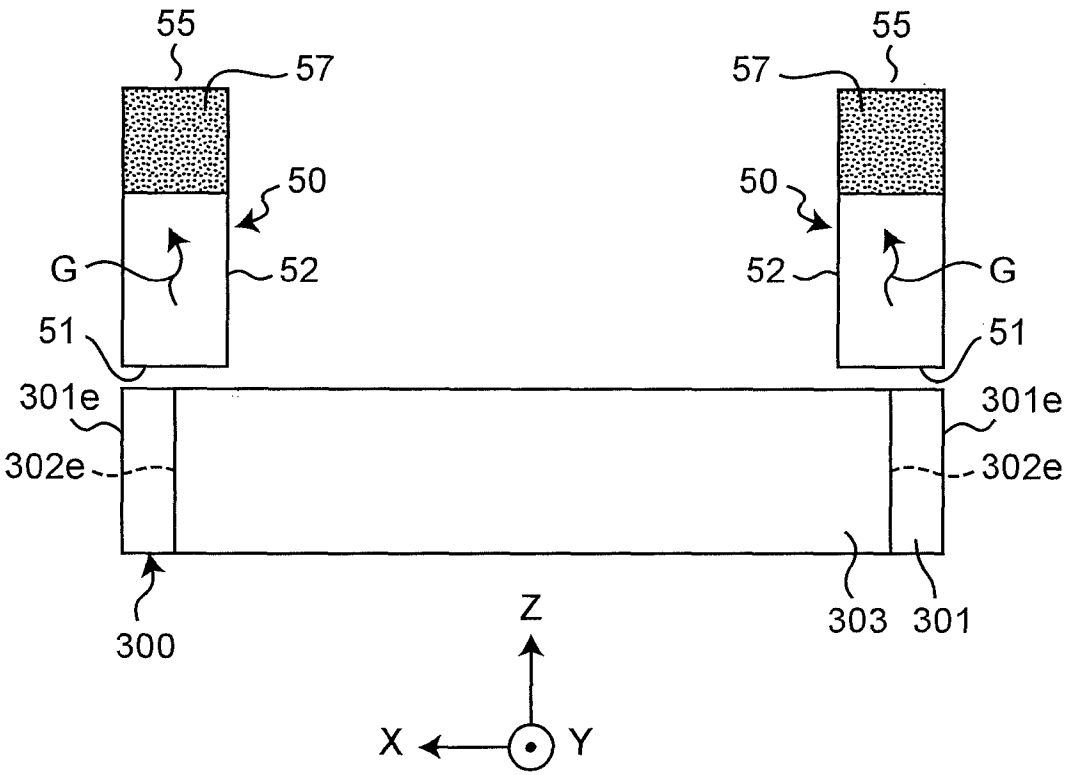
Figure 8B:
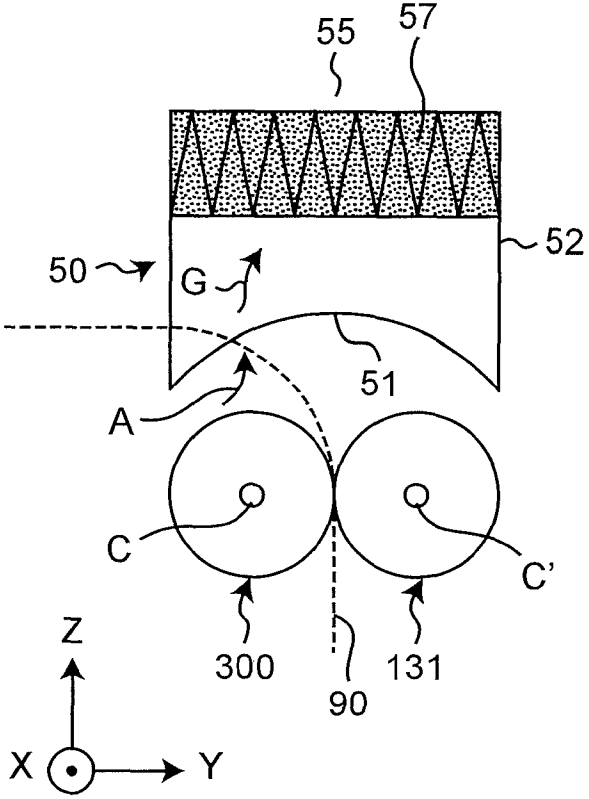
FIG. 8B is a view showing FIG. 8A as viewed from the left-hand side.

FIG. 8A shows another aspect of the vicinity of the fixing device included in the image forming apparatus 100 as viewed from a direction (+Y direction) perpendicular to the central shaft C of the fixing roller 300. FIG. 8B shows FIG. 8A as viewed from a left-hand side direction (+X direction). For easier understanding, the pressure roller 131 is omitted in FIG. 8A.

The fixing roller 300 itself shown in FIG. 8A and FIG. 8B (equivalent to the fixing roller 132 in FIG. 1) is similar to the general fixing roller shown in FIG. 15A as in the third embodiment. Materials, properties and thickness of a core metal 301, a rubber layer 302 and an outer layer 303, which constitute the fixing roller 300, are identical to those of the core metal 11, the rubber layer 12 and the outer layer 13 in the first embodiment, and therefore individual explanation thereabout will be omitted. A heater (equivalent to the heater 133 in FIG. 1) is provided in the internal space of the core metal 301 as a heating source for heating the fixing roller 300 to a specified target temperature (a fixing temperature in the range of 180° C. to 200° C. in this example).

A pressure roller 131 as a pressure member has a cylindrical outline (central shaft C') with a length generally the same as the length of the fixing roller 300 as in the third embodiment. More specifically, the pressure roller 131 is substantially equal in size to the fixing roller 300 with respect to the direction (direction X) along the central shaft C of the fixing roller 300. The pressure roller 131 has three-layer structure composed of a core metal, a middle layer and an outer layer similar to the fixing roller 300 in this example. Materials, properties and thickness of the core metal, the middle layer and the outer layer, which constitute the pressure roller 131, are similar to those of the fixing roller 300 in this example, and therefore individual explanation thereabout will be omitted.

In this embodiment, a pair of ducts 50, 50 supported and fixed onto the main body casing 101 via an unshown frame is provided in the vicinity of the fixing roller 300. Each of the ducts 50 may be made of any one of resin materials having heat tolerance to the fixing temperature or metallic materials such as aluminum and iron.

As shown in FIGS. 8A and 8B, each of the ducts 50 includes an inlet 51 provided around the core metal 301 in a position facing an end portion 302*e* of the rubber layer 302 along the circumferential direction, and a vertical section 52 extending upward in a vertical direction (direction Z) from the inlets 51. The upper part of the vertical section part 52 constitutes an outlet 55 of the duct 50.

As clearly shown in FIG. 8B, the inlet 51 of the duct 50 is provided over the upper side of the end portion 302*e* of the rubber layer 302 (and an end portion 303*e* of the outer layer 303) in the fixing roller 300 and the upper side of a portion of the pressure roller 131 corresponding to the end portion 302*e* of the rubber layer 302, straddling both of them. The inlet 51 of the duct 50 is curved upward in a concave manner so as to cover the end portion 302*e* of the rubber layer 302 (and the end portion 303*e* of the outer layer 303) in the fixing roller 300 and a portion of the pressure roller 131 corresponding to the end portion 302*e* of the rubber layer 302.

As shown in FIG. 8A and FIG. 8B, a filter member 57 capable of trapping ultra fine particles G generated from (the end portion 302*e* of) the rubber layer 302 of the fixing roller 300 is provided in a portion inside the vertical section 52 of the duct 50 which faces the outlet 55. It is to be noted that product names and functions of the filter member 57 are identical to those of the filter member 14 in the first embodiment.

In this embodiment, the air flow generation section is composed of a fixing roller 300 which is heated to the fixing temperature during operation and thereby generates an ascending air current A and a pressure roller 131 whose temperature rises to a certain level with the temperature rise of the fixing roller 300.

In this image forming apparatus, once the fixing roller 300 is heated to the fixing temperature during operation, ultra fine particles G such as siloxanes (with a particle size of 100 nm or less) are generated from the rubber layer 302 of the fixing roller 300. Since the outer surface 302*a* of the rubber layer 302 is covered with the outer layer 303, the ultra fine particles G are likely to be emitted from the end portion 302*e* of the rubber layer 302. The ultra fine particles G which are likely to be emitted from the end portion 302*e* of the rubber layer 302 ride on the ascending air current A generated by the fixing roller 300 and are taken into the duct 50 through the inlet 51 provided around the core metal 301 in a position facing the end portion 302*e* of the rubber layer 302 along the circumferential direction. The ultra fine particle G taken into the duct 50 ride on the ascending air current A and flow from the inlet 51 to the outlet 55 of the duct 50 through the vertical section 52 of the duct 50. The ultra fine particles G flowing through the duct 50 are then trapped by the filter member 57 provided in a portion facing the outlet 55 of the duct 50. As a result, the image forming apparatus can prevent contamination of the environment inside and around the apparatus.

In this image forming apparatus, the air flow generation section is composed of existing fixing roller 300 and existing pressure roller 131. Therefore, the cost increase caused by taking a measure against ultra fine particles can be suppressed. Moreover, as compared with the duct 30 in the third embodiment for example, the size (volume) of the ducts 50, 50 can be reduced. As a result, it becomes possible to downsize the image forming apparatus and to further suppress the cost increase.

Seventh Embodiment

Figure 9A:
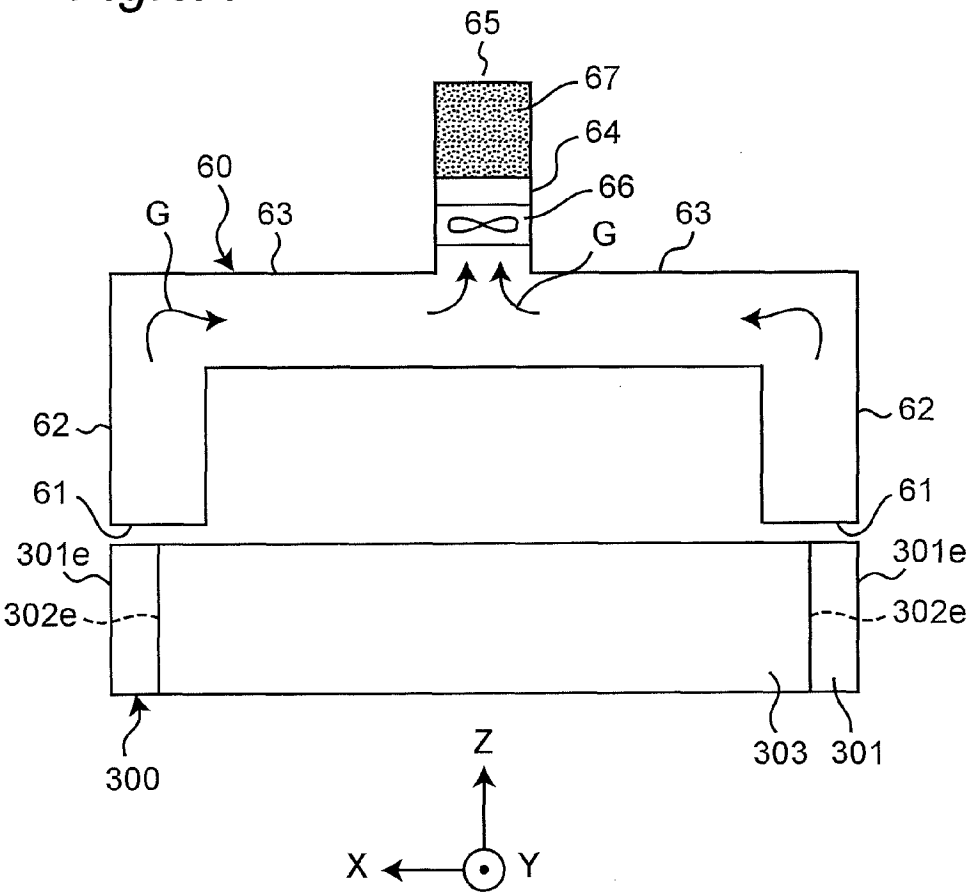
Figure 9B:
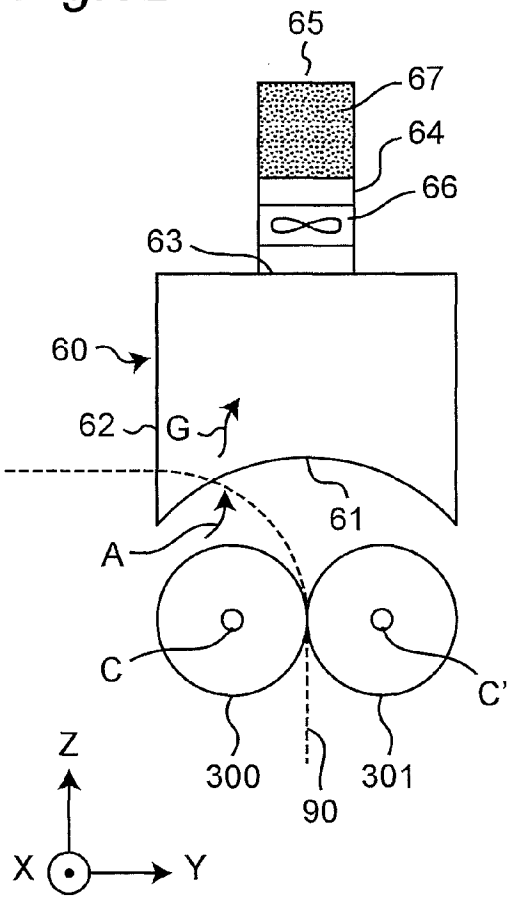
FIG. 9B is a view showing FIG. 9A as viewed from the left-hand side.

FIG. 9A shows another aspect of the vicinity of the fixing device included in the image forming apparatus 100 as viewed from a direction (+Y direction) perpendicular to the central shaft C of the fixing roller 300. FIG. 9B shows FIG. 9A as viewed from a left-hand side direction (+X direction). For easier understanding, the pressure roller 131 is omitted in FIG. 9A.

The fixing roller 300 itself shown in FIG. 9A and FIG. 9B (equivalent to the fixing roller 132 in FIG. 1) is similar to the general fixing roller shown in FIG. 15A as in the third embodiment. Materials, properties and thickness of a core metal 301, a rubber layer 302 and an outer layer 303, which constitute the fixing roller 300, are identical to those of the core metal 11, the rubber layer 12 and the outer layer 13 in the first embodiment, and therefore individual explanation thereabout will be omitted. A heater (equivalent to the heater 133 in FIG. 1) is provided in the internal space of the core metal 301 as a heating source for heating the fixing roller 300 to a specified target temperature (a fixing temperature in the range of 180° C. to 200° C. in this example).

A pressure roller 131 as a pressure member has a cylindrical outline (central shaft C') with a length generally the same as the length of the fixing roller 300 as in the third embodiment. More specifically, the pressure roller 131 is substantially equal in size to the fixing roller 300 with respect to the direction (direction X) along the central shaft C of the fixing roller 300. The pressure roller 131 has three-layer structure composed of a core metal, a middle layer and an outer layer similar to the fixing roller 300 in this example. Materials, properties and thickness of the core metal, the middle layer and the outer layer, which constitute the pressure roller 131, are similar to those of the fixing roller 300 in this example, and therefore individual explanation thereabout will be omitted.

In this embodiment, a duct 60 supported and fixed onto the main body casing 101 via an unshown frame is provided in the vicinity of the fixing roller 300. The duct 60 may be made of any one of resin materials having heat tolerance to the fixing temperature or metallic materials such as aluminum and iron.

The duct 60 is composed of a pair of inlets 61, 61 provided around the core metal 301 in a position facing an end portion 302*e* of the rubber layer 302 along the circumferential direction, a pair of first vertical sections 62, 62 extending upward in a vertical direction (direction Z) from the inlets 61, 61, a pair of horizontal sections 63, 63 each communicating with the upper parts of the first vertical sections 62, 62, extending in a horizontal direction (direction X) from the upper parts of the first vertical sections 62, 62, and joining together in a spot corresponding to the central section of the fixing roller 300, and a second vertical section 64 communicating with the joining spot of these horizontal sections 63, 63 and extending upward in the vertical direction (direction Z) from the joining spot. The upper part of the second vertical part 64 constitutes an outlet 65 of the duct 60.

As clearly shown in FIG. 9B, the inlet 61 of the duct 60 is provided over the upper side of the end portion 302*e* of the rubber layer 302 (and an end portion 303*e* of the outer layer 303) in the fixing roller 300 and the upper side of a portion of the pressure roller 131 corresponding to the end portion 302*e* of the rubber layer 302, straddling both of them. The inlet 61 of the duct 60 is curved upward in a protruding manner so as to cover the end portion 302*e* of the rubber layer 302 (and the end portion 303*e* of the outer layer 303) in the fixing roller 300 and a portion of the pressure roller 131 corresponding to the end portion 302*e* of the rubber layer 302.

As shown in FIG. 9A and FIG. 9B, a filter member capable of trapping ultra fine particles G generated from (the end portion 302*e* of) the rubber layer 302 of the fixing roller 300 is provided in a portion inside the vertical section 62 of the duct 60 which faces the outlet 65. It is to be noted that product names and functions of the filter member 67 are identical to those of the filter member 14 in the first embodiment.

An exhaust fan 66 for generating an air current flowing from the inlet 61 to the outlet 65 of the duct 60 is provided in a portion inside the second vertical section 64 of the duct 60 which corresponds to the upstream of the filter member 67.

In this embodiment, the air flow generation section is composed of a fixing roller 300 which is heated to the fixing temperature during operation and thereby generates an ascending air current A, a pressure roller 131 whose temperature rises to a certain level with the temperature rise of the fixing roller 300, and an exhaust fan 66.

In this image forming apparatus, once the fixing roller 300 is heated to the fixing temperature during operation, ultra fine particles G such as siloxanes (with a particle size of 100 nm or less) are generated from the rubber layer 302 of the fixing roller. Since the outer surface 302*a* of the rubber layer 302 is covered with the outer layer 303, the ultra fine particles G are likely to be emitted from the end portion 302*e* of the rubber layer 302. The ultra fine particles G which are likely to be emitted from the end portion 302*e* of the rubber layer 302 ride on the ascending air current A generated by the fixing roller 300 and are taken into the duct 60 through the inlet 61 provided around the core metal 301 in a position facing the end portion 302*e* of the rubber layer 302 along the circumferential direction. The ultra fine particles G taken into the duct 60 ride on the ascending air current A and flow from the inlet 61 to the outlet 65 of the duct 60 through the first vertical section 62, the horizontal section 63 and the second vertical section 64 of the duct 60. The ultra fine particles G flowing through the duct 60 are trapped by the filter member 67 provided in a portion facing the outlet 65 of the duct 60. As a result, the image forming apparatus can prevent contamination of the environment inside and around the apparatus.

In this image forming apparatus, the air flow generation section is composed of existing fixing roller 300, pressure roller 131 and an exhaust fan 66. Therefore, it becomes possible to ensure generation of an ascending air current A flowing from the inlet 61 to the outlet 65 of the duct 60.

As with the case of the third to fifth embodiments, the exhaust fan 66 may be placed on the downstream of the filter member 67 in consideration of the pressure loss of the filter member and the ascending air current generated by the temperature rise in the fixing roller.

Eighth Embodiment

Figures 10A, 10B, 10C:
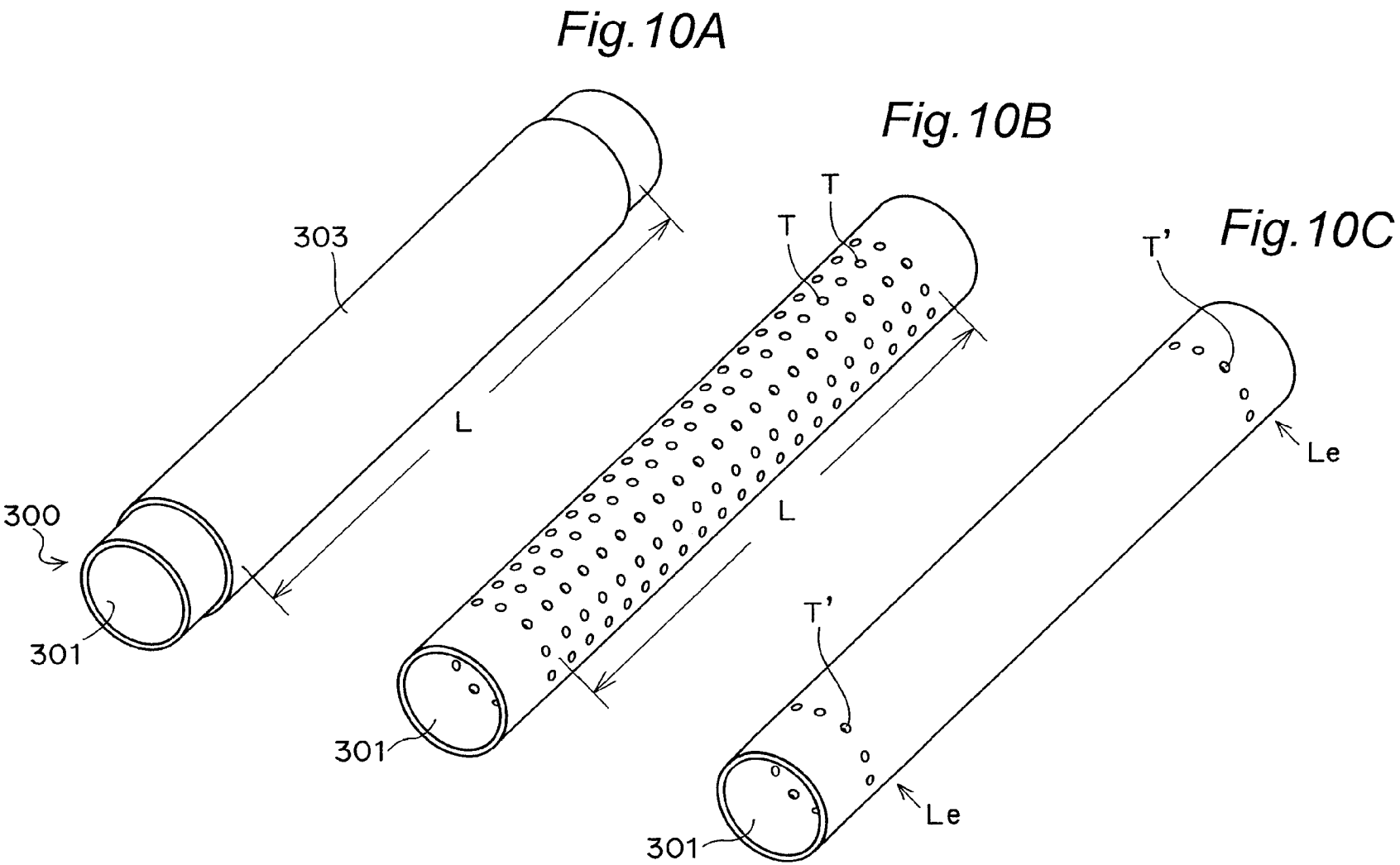
FIG. 10A is a perspective view showing a general completed state of a fixing roller.
FIG. 10B is a perspective view showing one aspect of a base material used for constituting a fixing roller.
FIG. 10C is a perspective view showing another aspect of the base material used for constituting a fixing roller.

FIG. 10A shows a completed form of a general fixing roller 300 as viewed in an oblique direction. A general fixing roller 300 is manufactured by setting a core metal 301 and a tube-type outer layer 303 into a mold, injection-molding a rubber layer 302 between the core metal 301 and the outer layer 303, and then conducting secondary vulcanization. FIG. 10B shows the state in which a plurality of through holes T, T, . . . which pass through an outer surface and an inner surface of the core metal 301 are provided so as to be distributed throughout the entire region corresponding to a region L on the core metal 301 of the fixing roller 300, the region L being occupied by the outer layer 303 (and the rubber layer 302), with respect to the direction along the central shaft of a core metal 71. Thus, by providing a plurality of the through holes T, T, . . . over the entire region L of the core metal 301 which is occupied by the rubber layer 302, it becomes easy to release unnecessary substances such as ultra fine particles (e.g., siloxanes) through a plurality of the through holes T, T, . . . in the secondary vulcanization step. Therefore, the emission amount of ultra fine particles can be reduced after completion of the fixing roller 300. FIG. 10C shows the state in which such a plurality of the through hole T, T, . . . are provided only in an end portion Le in the region L on the core metal 301 of the fixing roller 300, the region L being occupied by the outer layer 303 (and the aforementioned rubber layer 302), with respect to the direction along the central shaft of the core metal 71. In the embodiment describe below, a core metal is used which has a plurality of through holes as with the core metal 301 shown in FIG. 10B.

Figure 11:
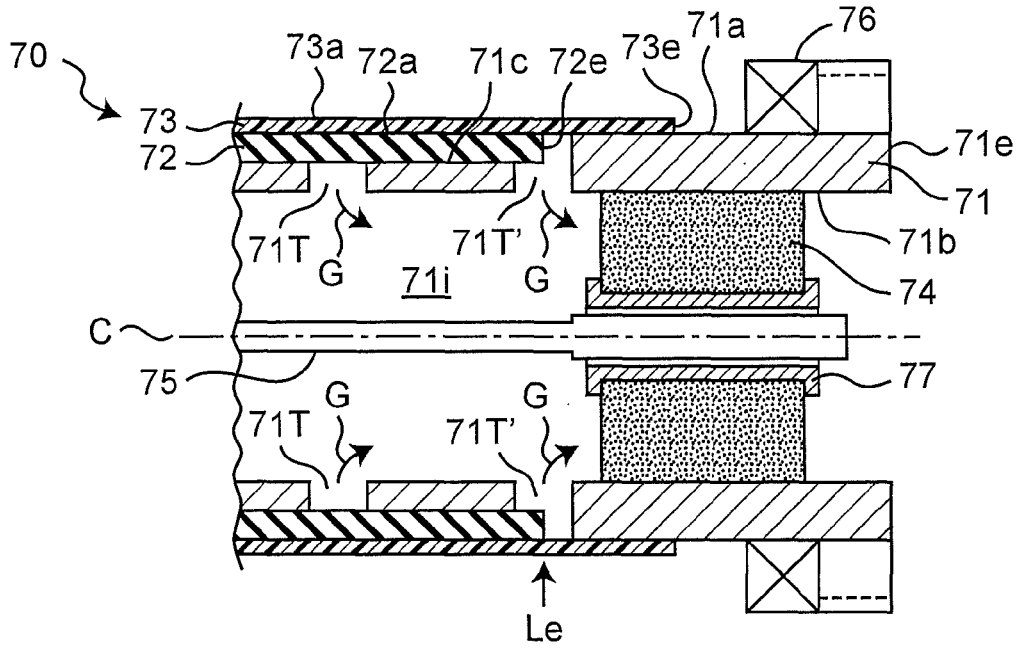
FIG. 11 is a cross sectional view showing another aspect of the vicinity of the fixing roller included in the image forming apparatus.

FIG. 11 is a cross sectional view showing another aspect of the vicinity of the fixing roller included in the image forming apparatus 100.

In this embodiment, a fixing roller 70 is composed of three layers including a core metal 71 as a cylindrical base material, a rubber layer 72 provided so as to cover an outer surface 71*a* (later-described 71*c*) of the core metal 71, and an outer layer 73 provided so as to cover an outer surface 72*a* of the rubber layer 72. A heater 75 (equivalent to the heater 133 in FIG. 1) is provided in the internal space of the core metal 71 as a heating source for heating the fixing roller 70 to a specified target temperature (a fixing temperature in the range of 180° C. to 200° C. in this example).

Material and properties of the core metal 71 and thickness in the vicinity of the end portion of the core metal 71, as well as materials, properties and thickness of the rubber layer 72 and the outer layer 73 are identical to those of the core metal 11, the rubber layer 12 and the outer layer 13 in the first embodiment, and therefore individual explanation thereabout will be omitted.

An end portion 71*e* of the core metal 71 is supported onto the main body casing 101 via a bearing 76. Accordingly, the frame core metal 71 can rotate around a central shaft C. An end portion (right end in FIG. 11) of the heater 75 is supported by a bearing 77 with respect to the end portion 71*e* of the core metal 71. Accordingly, when the core metal 71 rotates around the central shaft C, the heater 75 can maintain a quiescent state.

An end portion 72*e* of the rubber layer 72 and an end portion 73*e* of the outer layer 73 are each placed inner than the end portion 71*e* of the core metal 71 with respect to the direction along the central shaft C of the core metal 71, i.e., a width direction of a paper sheet 90 which should be brought into pressure contact with the fixing roller 70. The end portion 73*e* of the outer layer 73 is located in a position closer to the end portion 71*e* of the core metal 71 than the end portion 72*e* of the rubber layer 72 unlike the configuration in the first embodiment.

Furthermore, in this embodiment, a region of the outer surface 71*a* of the core metal 71 which corresponds to the rubber layer 72 is depressed in proportion to the thickness of the rubber layer 72 so that the outer layer 73 becomes flat with respect to the direction along the central shaft C. Thus, since the outer layer 73 is flat (has no wrinkles), the end portion 73*e* of the outer layer 73 is sufficiently in tight contact with the outer surface 71*a* near the end portion 71*e* of the core metal 71. As a result, a sealing section for covering the end portion 72*e* of the rubber layer 72 is formed by the end portion 73*e* of the outer layer 73 which is in tight contact with the outer surface 71*a* near the end portion 71*e* of the core metal 71. Therefore, the cost increase caused by taking a measure against ultra fine particles can be suppressed.

A plurality of through holes 71T, 71T', . . . which pass through the outer surface 71*a* and an inner surface 71*b* of the core metal 71 are formed so as to be distributed throughout a region (equivalent to the region L in FIG. 10B) on the core metal 71 which corresponds to the rubber layer 72 with respect to the direction along the central shaft C of the core metal 71, i.e., the width direction of a paper sheet 90 which should be brought into pressure contact with the fixing roller 70. Since a plurality of the through holes 71T, 71T', . . . are formed so as to be distributed throughout the region L corresponding to the rubber layer 72, the ultra fine particles G generated from the rubber layer 72 can easily be emitted to an internal space 71*i* of the core metal 71 through a plurality of the through holes 71T, 71T', . . . . Moreover, it becomes easy to release unnecessary substances such as ultra fine particles (e.g., siloxanes) through a plurality of the through holes 71T, 71T', . . . in the secondary vulcanization step (aforementioned) in the manufacturing process of the fixing roller 70. Therefore, the emission amount of ultra fine particles can be reduced in the completed fixing roller 300.

Some through holes 71T' (equivalent to T' in FIG. 10C) out of a plurality of the through holes 71T, 71T' . . . are provided in a position Le (equivalent to Le in FIG. 10C) over the end portion 72*e* of the rubber layer 72 with respect to the direction along the central shaft C of the core metal 71. Therefore, the ultra fine particles G which are likely to be emitted from the end portion 72*e* of the rubber layer 72 to the outside of the rubber layer 72 are smoothly emitted to the internal space 71*i* of the core metal 71 through the through holes 71T' provided over the end portion 72*e* of the rubber layer 72. As a result, the ultra fine particles G which are likely to be emitted from the end portion 72*e* of the rubber layer 72 to the outside of the rubber layer 72 are prevented from damaging the sealing section which covers the end portion 72*e* of the rubber layer 72 (i.e., a tight contact between the outer surface 71*a* near the end portion 71*e* of the core metal 71 and the end portion 73*e* of the outer layer 73).

If a closed space (clearance) should be generated at the end portion 72*e* of the rubber layer 72, repeated temperature rise and fall in the fixing roller 70 may cause separation between the rubber layer 72 and the outer layer due to a difference in expansion coefficient therebetween. In this regard, in this image forming apparatus, some through holes 71T' are provided in the position Le over the end portion 72*e* of the rubber layer 72. Therefore, it becomes possible to prevent separation between the rubber layer 72 and the outer layer 73.

A filter member 74 capable of trapping ultra fine particles G generated from the rubber layer 72 is provided in a region of the internal space 71*i* of the core metal 71 which corresponds to the outside of a plurality of the through holes 71T, 71T', . . . with respect to the direction along the central shaft C of the core metal 71. The filter member 74 is placed in between the inner surface 71*b* near the end portion 71*e* of the core metal 71 and the bearing 77. By placing the filter member 74 in this way, it becomes possible to easily secure the volume of the filter member 74, as a result of which the ultra fine particles G can be trapped over a long period of time.

As a filtering medium of the filter member 74, the filtering medium of the filter member 14 in the first embodiment can be used. In this embodiment, the volume of the filter member 74 can easily be secured, so that the filtering medium having carbon or PTFE (polytetrafluoroethylene) as a main component can be applied to the filter member 74. With carbon as a main component, heat tolerance of the filter member 74 can easily be implemented. Further, the filter member 74 can be structured rather easily. Further, it becomes easy to secure the surface area of the filter member 74, as a result of which the ultra fine particles G can be trapped over a longer period of time. With PTFE as a main component, heat tolerance of the filter member 74 can easily be implemented.

In the image forming apparatus having the fixing roller 70, the fixing roller 70 is heated by the heater 75 to a fixing temperature in the range of 180° C. to 200° C. as in the first embodiment. A conveyed paper sheet 90 is brought into pressure contact with the outer surface 73*a* of the fixing roller 70 to fix an image on the paper sheet 90.

Once the fixing roller 70 is heated to the fixing temperature, ultra fine particles such as siloxanes (with a particle size of 100 nm or less) are generated from the rubber layer 72 of the fixing roller 70. In this case, as mentioned before, the outer surface 72*a* of the rubber layer 72 is covered with the outer layer 73. Moreover, the end portion 72*e* of the rubber layer 72 is covered with the sealing section (i.e., a tight contact between the outer surface 71*a* near the end portion 71*e* of the core metal 71 and the end portion 73*e* of the outer layer 73). Accordingly, in this image forming apparatus, the ultra fine particles G generated from the rubber layer 72 of the fixing roller 70 are likely to be emitted to the internal space 71*i* of the core metal 71 through a plurality of the through holes 71T, 71T', . . . provided in the core metal 71 and are further likely to move through the internal space 71*i* of the core metal 71 in the direction along the central shaft C and come out of the core metal 71. The ultra fine particles G which are likely to come out of the core metal 71 are trapped by the filter member 74. As a result, the image forming apparatus can prevent contamination of the environment inside and around the apparatus.

Ninth Embodiment

Figure 12:
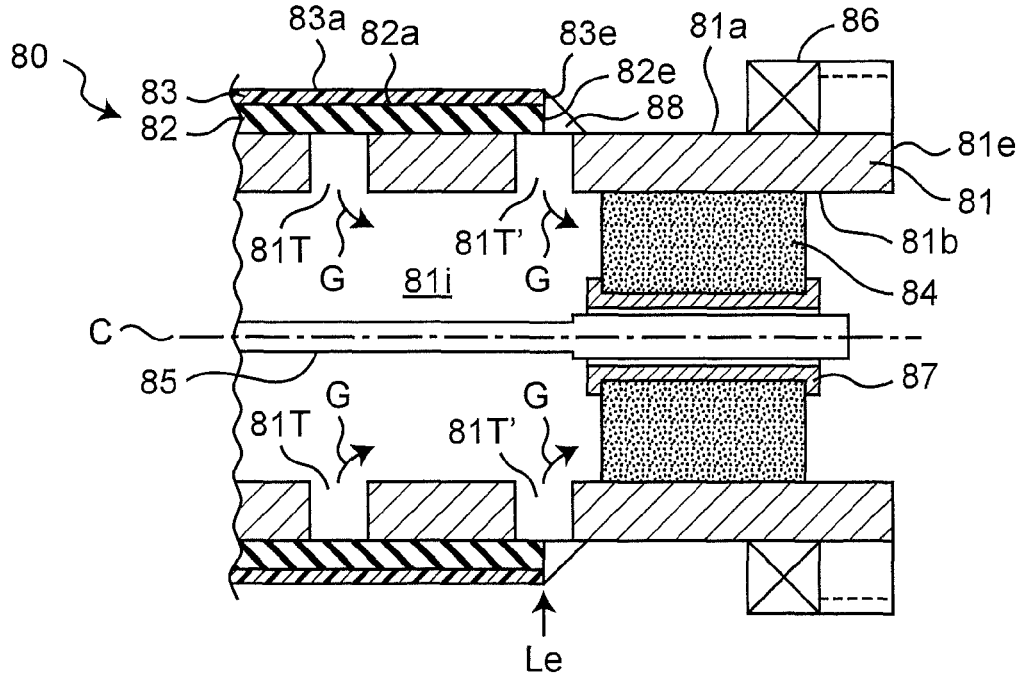
FIG. 12 is a cross sectional view showing another aspect of the vicinity of the fixing roller included in the image forming apparatus.

FIG. 12 is a cross sectional view showing another aspect of the vicinity of the fixing roller included in the image forming apparatus 100.

Also in this embodiment, a core metal is used which has a plurality of through holes as with the core metal 301 shown in FIG. 10B.

In this embodiment, the fixing roller 80 is composed of three layers including a core metal 81 as a cylindrical base material, a rubber layer 82 provided so as to cover an outer surface 81*a* of the core metal 81, and an outer layer 83 provided so as to cover an outer surface 82*a* of the rubber layer 82. A heater 85 (equivalent to the heater 133 in FIG. 1) is provided in the internal space of the core metal 81 as a heating source for heating the fixing roller 80 to a specified target temperature (a fixing temperature in the range of 180° C. to 200° C. in this example).

Materials, properties and thickness of the core metal 81, the rubber layer 82 and the outer layer 83 are identical to those of the core metal 11, the rubber layer and the outer layer 13 in the first embodiment, and therefore individual explanation thereabout will be omitted.

An end portion 81*e* of the core metal 81 is supported onto the main body casing 101 via a bearing 86. Accordingly, the frame core metal 81 can rotate around a central shaft C. An end portion (right end in FIG. 11) of the heater 85 is supported by a bearing 87 with respect to the end portion 81*e* of the core metal 81. Accordingly, when the core metal 81 rotates around the central shaft C, the heater 85 can maintain a quiescent state.

An end portion 82*e* of the rubber layer 82 and an end portion 83*e* of the outer layer 83 are each placed in the same position inner than the end portion 81*e* of the core metal 81 with respect to the direction along the central shaft C of the core metal 81, i.e., a width direction of a paper sheet 90 which should be brought into pressure contact with the fixing roller 80.

In this embodiment, a sealant 88 as a sealing section is provided on the core metal 81 along the circumferential direction for sealing the end portion 82*e* of the rubber layer 82 together with the end portion 83*e* of the outer layer 83. The sealant 88 is made of a fluorine-based adhesive. Therefore, the sealant 88 does not generate siloxanes and therefore does not become an emission source of ultra fine particles. The sealant 88 can reliably cover the end portion 82*e* of the rubber layer 82. Unlike the eighth embodiment, it is not necessary to apply special processing to the outer surface 81*a* of the core metal 81 for forming any depression in proportion to the thickness of the rubber layer.

A plurality of through holes 81T, 81T', . . . which pass through the outer surface 81*a* and an inner surface 81*b* of the core metal 81 are formed so as to be distributed throughout a region (equivalent to the region L in FIG. 10B) on the core metal 81 which corresponds to the rubber layer 82 with respect to the direction along the central shaft C of the core metal 81, i.e., the width direction of a paper sheet 90 which should be brought into pressure contact with the fixing roller 80. Since a plurality of the through holes 81T, 81T', . . . are formed so as to be distributed throughout the region L corresponding to the rubber layer 82, the ultra fine particles G generated from the rubber layer 82 can easily be emitted to an internal space 81*i* of the core metal 81 through a plurality of the through holes 81T, 81T', . . . . Moreover, it becomes easy to release unnecessary substances such as ultra fine particles (e.g., siloxanes) through a plurality of the through holes 81T, 81T', . . . in the secondary vulcanization step (aforementioned) in the manufacturing process of the fixing roller 80. Therefore, the emission amount of ultra fine particles can be reduced in the completed fixing roller 80.

Some through holes 81T' (equivalent to T' in FIG. 10C) out of a plurality of the through holes 81T, 81T' . . . are provided in a position Le (equivalent to Le in FIG. 10C) over the end portion 82*e* of the rubber layer 82 with respect to the direction along the central shaft C of the core metal 81. Therefore, the ultra fine particles G which are likely to be emitted from the end portion 82*e* of the rubber layer 82 to the outside of the rubber layer 82 are smoothly emitted to the internal space 81*i* of the core metal 81 through the through hole 81T' provided over the end portion 82*e* of the rubber layer 82. Consequently, the ultra fine-particles G which are likely to be emitted from the end portion 82*e* of the rubber layer 82 to the outside of the rubber layer 82 are prevented from damaging the sealant 88 which covers the end portion 82*e* of the rubber layer 82.

If a closed space (clearance) should be generated at the end portion 82*e* of the rubber layer 82, repeated temperature rise and fall in the fixing roller 80 may cause separation between the rubber layer 82 and the outer layer due to a difference in expansion coefficient therebetween. In this regard, in this image forming apparatus, some through holes 81T' are provided in the position Le over the end portion 82*e* of the rubber layer 82. Therefore, it becomes possible to prevent separation between the rubber layer 82 and the outer layer 83.

A filter member 84 capable of trapping ultra fine particles G generated from the rubber layer 82 is provided in a region of the internal space 81*i* of the core metal 81 which corresponds to the outside of a plurality of the through holes 81T, 81T', . . . with respect to the direction along the central shaft C of the core metal 71. The filter member 84 is placed in between the inner surface 81*b* near the end portion 81*e* of the core metal 81 and the bearing 87. By placing the filter member 84 in this way, it becomes possible to easily secure the volume of the filter member 84, as a result of which the ultra fine particles G can be trapped over a long period of time.

As a filtering medium of the filter member 84, the filtering medium of the filter member 14 in the first embodiment can be used. The filtering medium with carbon or PTFE as a main component can be used as in the eighth embodiment.

In the image forming apparatus having the fixing roller 80, the fixing roller 80 is heated by a heater 85 to a fixing temperature in the range of 180° C. to 200° C. as in the first embodiment. A conveyed paper sheet 90 is brought into pressure contact with the outer surface 83*a* of the fixing roller 80 to fix an image on the paper sheet 90.

Once the fixing roller 80 is heated to the fixing temperature, ultra fine particles such as siloxanes (with a particle size of 100 nm or less) are generated from the rubber layer 82 of the fixing roller 80. In this case, as mentioned before, the outer surface 82*a* of the rubber layer 82 is covered with the outer layer 83. The end portion 82*e* of the rubber layer 82 is covered with the sealant 88 together with the end portion 83*e* of the outer layer 83. Accordingly, in this image forming apparatus, the ultra fine particles G generated from the rubber layer 82 of the fixing roller 80 are likely to be emitted to the internal space 81*i* of the core metal 81 through a plurality of the through holes 81T, 81T', . . . provided in the core metal 81 and are further likely to move through the internal space 81*i* of the core metal 81 in the direction along the central shaft C and come out of the core metal 81. The ultra fine particles G which are likely to come out of the core metal 81 are then trapped by the filter member 84. As a result, the image forming apparatus can prevent contamination of the environment inside and around the apparatus.

Tenth Embodiment

Figure 13:
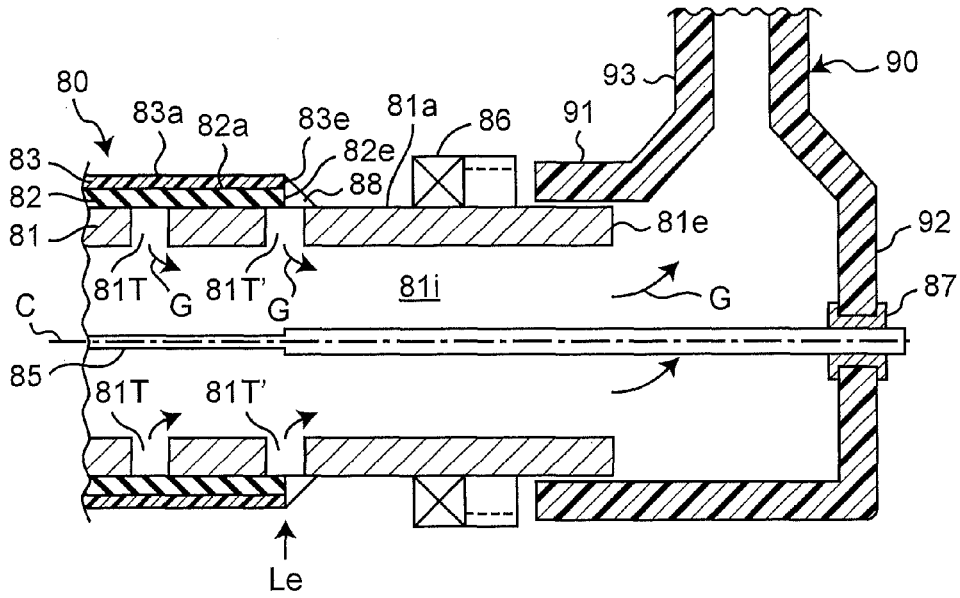
FIG. 13 is a cross sectional view showing another aspect of the vicinity of the fixing roller included in the image forming apparatus.

FIG. 13 is a cross sectional view showing another aspect of the vicinity of the fixing roller included in the image forming apparatus 100.

In this embodiment, a duct 90 is connected to the end portion of the core metal 81, whereas the filter member 84 was provided in the internal space 81*i* of the core metal in the ninth embodiment (FIG. 12). In FIG. 13, component members identical to those in FIG. 12 are designated by identical reference signs to omit redundant explanation about individual component members.

As shown in FIG. 13, in this embodiment, a duct 90 is fittingly provided in the end portion 81*e* of the core metal 81 of the fixing roller 80.

The duct 90 is composed of an inlet 91 with the shape of a short cylinder fitted onto the outer circumference of the end portion 81*e* of the core metal 81, a box section 92 communicating with the inlet 91, and a vertical section 93 extending upward in a vertical direction from the upper part of the box section 92. The upper part of the vertical section 93 constitutes an outlet (not shown) of the duct 90. A slight clearance is provided between the outer circumference of the end portion 81*e* of the core metal 81 and the inner circumference of the inlet so as to allow for rotation of the fixing roller 80 around the central shaft C (core metal 81). It is to be noted that an end portion (right end in FIG. 13) of the heater 85 is supported onto a sidewall of the box section 92 of the duct 90 via the bearing 87.

As in the case of the third embodiment (see FIG. 4A and FIG. 4B) for example, a filter member (not shown) capable of trapping ultra fine particles G generated by the rubber layer 82 of the fixing roller 80 is provided in a portion inside the vertical section 93 of the duct 90 which faces an outlet of the duct. Similarly, an exhaust fan (not shown) as an air flow generation section is provided in a portion inside the vertical section 93 of the duct 90 which corresponds to the upstream of the filter member. In consideration of the pressure loss of the filter member and the ascending air current generated due to the temperature rise in the fixing roller, the exhaust fan may be placed on the downstream of the filter member.

In this image forming apparatus, the fixing roller 80 is heated by the heater 85 to a fixing temperature in the range of 180° C. to 200° C. as in the ninth embodiment. A conveyed paper sheet 90 is brought into pressure contact with the outer surface 83*a* of the fixing roller 80 to fix an image on the paper sheet 90.

Once the fixing roller 80 is heated to the fixing temperature, ultra fine particles such as siloxanes (with a particle size of 100 nm or less) are generated from the rubber layer 82 of the fixing roller 80. In this case, the outer surface 82*a* of the rubber layer 82 is covered with the outer layer 83. The end portion 82*e* of the rubber layer 82 is covered with the sealant 88 together with the end portion 83*e* of the outer layer 83. Accordingly, in this image forming apparatus, the ultra fine particles G generated from the rubber layer 82 of the fixing roller 80 are likely to be emitted to the internal space 81*i* of the core metal 81 through a plurality of the through holes 81T, 81T', . . . provided in the core metal 81 and are further likely to move through the internal space 81*i* of the core metal 81 in the direction along the central shaft C and come out of the core metal 81. The ultra fine particles G which are likely to come out of the core metal 81 are taken into the duct 90 from the inlet 91 fitted onto the outer circumference of the end portion 81*e* of the core metal 81. The ultra fine particles G taken into the duct 40 ride on the air current generated by the exhaust fan and flow from the inlet 91 to the outlet of the duct through the box section 92 and the vertical section 93 of the duct 90. The ultra fine particles G flowing through the duct 90 are then trapped by the filter member. As a result, the image forming apparatus can prevent contamination of the environment inside and around the apparatus.

It is to be noted that a very small opening may be provided in the left-side end portion (not shown) of the core metal 81 in FIG. 13 so that the exhaust fan can easily generate an air current in the internal space 81*i* of the core metal 81.

However, if the air current in the internal space 81*i* of the core metal 81 becomes too fast, the temperature of the fixing roller 80 decreases, leading to unstable temperature distribution. Accordingly, the speed of the air current in the internal space 81*i* of the core metal 81 should preferably be 0.1 m/s or less. This makes the decrease in temperature of the fixing roller 80 relatively small. Moreover, the efficiency of the filter member to trap the ultra fine particles is enhanced.

In the above-mentioned eighth, ninth and tenth embodiments, a plurality of the through holes 71T, 71T', . . . and 81T, 81T', . . . were formed so as to be distributed throughout the region L of the core metals 71, 81 which corresponds to the rubber layers 72, 82. However, without being limited thereto, a plurality of the through holes may be provided exclusively in a portion which is inside the region L of the core metal which corresponds to the rubber layer and outside the region with which a paper sheet 90 is brought into pressure contact, with respect to the direction along the central shaft. As shown in FIG. 10C for example, such a plurality of the through holes T', T', . . . may be provided only in the end portion Le of a region occupied by the outer layer and the rubber layer with respect to the direction along the central shaft of the core metal. In that case, the presence of a plurality of the through holes T', T', . . . does not affect the temperature distribution in the region of the fixing roller with which a paper sheet 90 should be brought into pressure contact.

Figure 14:
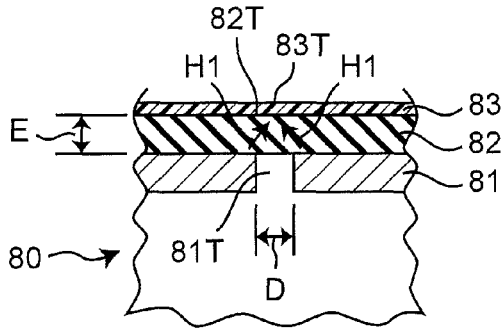
FIG. 14 is a view for explaining a function of the thickness of a rubber layer in the fixing roller.

In the above-mentioned eighth, ninth and tenth embodiments, the diameter of a plurality of the respective through holes T', T', . . . should preferably be equal to or less than the thickness of the rubber layers 72, 82. For example, as shown in FIG. 14, a diameter D of the through hole 81T should preferably be equal to or less than a thickness E of the rubber layer 82. In that case, heat H1, H1 from a portion of the core metal 81 around the through hole 81T for example transmit with relative ease to the surface of portions 82T, 83T of the rubber layer 82 and the outer layer 83 which cover the through hole 81T. Therefore, an influence exerted by the presence of a plurality of the through holes on the temperature distribution of the fixing roller 80 (temperature distribution of the outer layer 83) becomes relatively small. As a result, uneven temperature distribution can be reduced to the level which does not affect images.

For example, in the case where the thickness of the core metal 81 is 0.5 mm and the thickness of the rubber layer 82 is E=0.5 mm, a through hole with a diameter D=0.5 mm or less is formed in the core metal 81. Formation of such a through hole can easily be achieved by laser machining.

In the above-mentioned eighth, ninth and tenth embodiments, a higher pressure loss of the filter members 74, 84, . . . enhances trapping efficiency, though if the pressure loss characteristics of the filter members 74, 84, . . . are higher than the pressure loss characteristics of the outer layers 73, 83, then the ultra fine particles G generated from the rubber layers 72, 82 may transmit the outer layers 73, 83 and leak out. Accordingly, the pressure loss characteristics of the filter members 74, 84, . . . should preferably be ½ or less of the pressure loss characteristics of the outer layers 73, 83. In that case, ultra fine particles G generated from the rubber layer 72, 82 are likely to pass through the filter member 74, 84, . . . rather than to transmit the outer layers 73, 83. Therefore, it becomes easy to trap the ultra fine particles G with the filter member 74, 84, . . . .

In each of the above-mentioned embodiments, the fixing member was configured as a cylindrical fixing roller. It should naturally be understood that the present invention is not limited thereto but is preferably applicable to the case where the fixing member is an annular fixing belt.

The pressure roller in each of the above-mentioned embodiments can also be regarded as a fixing member. A heater may be built not only in the fixing roller but also in the pressure roller.

Although the present invention was applied to a tandem type color image forming apparatus in this embodiment, the invention is not limited to this configuration. The photoconductor, the charging means, the exposure means, the developing means, the transfer means, and the fixing means are not limited to have the configuration and layout disclosed in this embodiment but may have other configurations and layouts. The invention is widely applicable to the image forming apparatuses of other types such as rotary configuration type and direct transfer type.

The invention is also applicable to printers, copying machines, facsimiles and multi-functional machines having the functions of these as well as to hard copy systems for data processing/editing and printing.

As described above, an image forming apparatus according to a first aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes three layers composed of: a cylindrical or annular base material; a rubber layer provided so as to cover an outer surface of the base material and having elasticity to allow for a size of a region with which the sheet is put in pressure contact; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, and wherein a filter member capable of trapping ultra fine particles generated from the rubber layer is provided on the base material in a position facing the end portion of the rubber layer along the circumferential direction.

In the image forming apparatus in the first aspect, the fixing member is heated by the heating source to the specified target temperature (fixing temperature). A conveyed sheet is brought into pressure contact with the outer surface of the fixing member to fix an image onto the sheet. Once the fixing member is heated to the fixing temperature, ultra fine particles such as siloxanes (with a particle size of 100 nm or less) are generated from the rubber layer of the fixing member. Since the outer surface of the rubber layer is covered with the outer layer, the ultra fine particles are likely to be emitted from the end portion of the rubber layer. In this image forming apparatus, a filter member capable of trapping the ultra fine particles generated from the rubber layer is provided on the base material of the fixing member in a position facing the end portion of the rubber layer along the circumferential direction. Therefore, the ultra fine particles which are likely to be emitted from the end portion of the rubber layer are trapped by the filter member. As a result, the image forming apparatus can prevent contamination of the environment inside and around the apparatus.

It is to be noted that the gas pressure of the ultra fine particles (such as siloxanes) generated from the rubber layer is released through the filter member. This makes it possible to prevent separation between the rubber layer and the outer layer.

In the image forming apparatus of one embodiment, the filter member is in direct contact with the end portion of the rubber layer and with the end portion of the outer layer to cover the end portion of the rubber layer.

In the image forming apparatus of this one embodiment, the filter member is in direct contact with the end portion of the rubber layer and with the end portion of the outer layer to cover the end portion of the rubber layer. Therefore, it is ensured that the ultra fine particles which are likely to be emitted from the end portion of the rubber layer are trapped by the filter member. As a result, the image forming apparatus can reliably prevent contamination of the environment inside and, around the apparatus.

The image forming apparatus of one embodiment comprises a spring member provided on the base material in a position closer to the end portion of the base material than the filter member with respect to the width direction for biasing the filter member toward the end portion of the rubber layer.

In the image forming apparatus of this one embodiment, the filter member is biased toward the end portion of the rubber layer by the spring member. Therefore, the filter member is in close contact with the end portion of the rubber layer and with the end portion of the outer layer irrespective of the aged deterioration of each member. Therefore, it is further ensured that the ultra fine particles which are likely to be emitted from the end portion of the rubber layer are trapped by the filter member. As a result, the image forming apparatus can more reliably prevent contamination of the environment inside and around the apparatus.

In the image forming apparatus of one embodiment, the end portion of the outer layer is located in a position closer to the end portion of the base material than the end portion of the rubber layer with respect to the width direction on the base material, and wherein the filter member is placed in between the outer surface of the base material and an inner surface of the outer layer.

In the image forming apparatus of this one embodiment, the filter member is placed between the outer surface of the base material and the inner surface of the outer layer. Therefore, it is ensured that the ultra fine particles which are likely to be emitted from the end portion of the rubber layer are trapped by the filter member. As a result, the image forming apparatus can reliably prevent contamination of the environment inside and around the apparatus.

An image forming apparatus according to a second aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes three layers composed of: a cylindrical or annular base material; a rubber layer provided so as to cover an outer surface of the base material and having elasticity to allow for a size of a region with which the sheet is put in pressure contact; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, the mage forming apparatus further comprising:

a duct provided around the base material in a position facing the end portion of the rubber layer along the circumferential direction, and having an inlet for taking in ultra fine particles generated from the end portion of the rubber layer;

an air flow generation section for generating an air current flowing from the inlet to an outlet of the duct; and a filter member provided inside the duct or in the outlet so as to be able to trap the ultra fine particles which ride on the air current and flow through the duct.

In the image forming apparatus in the second aspect, the fixing member is heated by the heating source to the specified target temperature (fixing temperature). A conveyed sheet is brought into pressure contact with the outer surface of the fixing member to fix an image onto the sheet. Once the fixing member is heated to the fixing temperature, ultra fine particles such as siloxanes (with a particle size of 100 nm or less) are generated from the rubber layer of the fixing member. Since the outer surface of the rubber layer is covered with the outer layer, the ultra fine particles are likely to be emitted from the end portion of the rubber layer. In this image forming apparatus, the ultra fine particle which are likely to be emitted from the end portion of the rubber layer are taken into the duct around the base material through an inlet provided in a position facing the end portion of the rubber layer along the circumferential direction. The ultra fine particles taken into the duct ride on the air current generated by the air flow generation section and flow through the duct from the inlet to the outlet of the duct. The ultra fine particles which flow through the duct are trapped by the filter member provided inside the duct or in the outlet. As a result, the image forming apparatus can prevent contamination of the environment inside and around the apparatus.

It is to be noted that the gas pressure of the ultra fine particles (such as siloxanes) generated from the rubber layer is released through the filter member. This makes it possible to prevent separation between the rubber layer and the outer layer.

In the image forming apparatus of one embodiment, the inlet of the duct has a first sidewall positioned closer to the end portion of the base material than the end portion of the rubber layer with respect to the width direction on the base material, and a second sidewall positioned farther from the end portion of the base material than the end portion of the rubber layer, and wherein an inner peripheral edge of the first sidewall is distanced from the outer surface of the base material, while an inner peripheral edge of the second sidewall is in contact with the outer layer.

In the image forming apparatus of this one embodiment, the inner peripheral edge of the first sidewall that makes the inlet of the duct is distanced from the outer surface of the base material. Therefore, air near the inlet of the duct can flow into the duct through a clearance between the outer surface of the base material and the inner peripheral edge of the first sidewall. As a result, the air flow generation section can easily generate an air current flowing from the inlet to the outlet of the duct. Meanwhile, the inner peripheral edge of the second sidewall which makes the inlet of the duct is in contact with the outer layer. Therefore, air near the inlet of the duct does not flow into the duct from the second sidewall side opposite to the first sidewall. As a result, it becomes possible to prevent the temperature of a region (existing in a region corresponding to the rubber layer) of the fixing member, with which the sheet is brought into pressure contact, from decreasing.

In the image forming apparatus of one embodiment, a first sidewall facing section on the outer surface of the base material which faces the first sidewall of the duct is covered with a sleeve which is distanced from the inner peripheral edge of the first sidewall and which has heat insulation properties.

In the image forming apparatus of this one embodiment, the inner peripheral edge of the first sidewall that makes the inlet of the duct is distanced from the outer surface of the sleeve to form a clearance therewith. Therefore, air near the inlet of the duct flows into the duct through the clearance between the outer surface of the sleeve and the inner peripheral edge of the first sidewall. Accordingly, the air flowing into the duct tends to take away the heat of the first sidewall facing section on the outer surface of the base material, leading to temperature decrease in the first sidewall facing section. In the image forming apparatus of this embodiment, the first sidewall facing section is covered with the sleeve having heat insulation properties. Therefore, it becomes possible to prevent the temperature of the first sidewall facing section from decreasing.

In the image forming apparatus of one embodiment, a sealing member having heat insulation properties is attached to the inner peripheral edge of the second sidewall, and wherein the inner peripheral edge of the second sidewall is in contact with a second sidewall facing section on the outer surface of the outer layer via the sealing member.

In the image forming apparatus of this one embodiment, the inner peripheral edge of the second sidewall is in contact with a second sidewall facing section on the outer surface of the outer layer via the sealing member. Therefore, the sealing member effectively prevents the air near the inlet of the duct from flowing into the duct from the second sidewall side opposite to the first sidewall. As a result, with respect to the width direction, it becomes possible to effectively prevent the temperature in an image region (existing in a region corresponding to the rubber layer) of the fixing member, through which the sheet should pass, from decreasing. Moreover, a buffer effect by the sealing member prevents the inner peripheral edge of the second sidewall from coming into direct contact with the outer surface of the outer layer and causing damages thereby.

In the image forming apparatus of one embodiment, the air flow generation section comprises an exhaust fan provided inside the duct or in the outlet.

In the image forming apparatus of this one embodiment, the air current flowing from the inlet to the outlet of the duct can reliably be generated with the exhaust fan.

In the image forming apparatus of one embodiment, the duct extends upward from the inlet to the outlet, and wherein the air flow generation section comprises the fixing member which is heated to the specified target temperature for fixing operation and generates an ascending air current.

In the image forming apparatus of this one embodiment, the air flow generation section may be constituted from an existing fixing member. Therefore, the cost increase caused by taking a measure against ultra fine particles can be suppressed.

The image forming apparatus of one embodiment comprises:

a pressure member circumscribed with the fixing member to form a nip section so that the sheet is brought into pressure contact with the outer surface of the fixing member, wherein the pressure member is larger in size than the sheet and is smaller in size than the rubber layer and the outer layer with respect to the width direction, and wherein the inlet of the duct surrounds and covers all circumferences of the end portions of the rubber layer and the outer layer of the fixing member.

In the image forming apparatus of this one embodiment, the inlet of the duct surrounds and covers all circumstances of the end portions of the rubber layer and the outer layer, and therefore, the ultra fine particles emitted from the end portion of the rubber layer in the fixing member can reliably be taken into the duct through the inlet.

The image forming apparatus of one embodiment comprises:

a pressure member circumscribed with the fixing member to form a nip section so that the sheet is brought into pressure contact with the outer surface of the fixing member, wherein the pressure member is substantially equal in size to the fixing member with respect to the width direction, and wherein the inlet of the duct collectively surrounds and covers all circumferences of the end portion of the rubber layer in the fixing member and a portion of the pressure member corresponding to the end portion of the rubber layer.

In the image forming apparatus of this one embodiment, the inlet of the duct collectively surrounds and covers all circumferences of the end portion of the rubber layer in the fixing member and a portion of the pressure member corresponding to the end portion of the rubber layer. Therefore, not only the ultra fine particles emitted from the end portion of the rubber layer in the fixing member but also the ultra fine particles emitted from (the end portion of the rubber layer in) the pressure member can reliably be taken into the duct through the inlet.

An image forming apparatus according to a third aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the sealing member includes three layers composed of: a cylindrical base material, a rubber layer provided so as to cover an outer surface of the base material and having elasticity to allow for a size of a region with which the sheet is put in pressure contact; and an outer layer provided so as to cover an outer surface of the rubber layer for aiding release of the sheet, wherein an end portion of the rubber layer and an end portion of the outer layer are each positioned inner than the an end portion of the base material with respect to a width direction perpendicular to a circumferential direction on the base material, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material; and wherein a filter member capable of trapping ultra fine particles generated from the rubber layer is provided in a region of an internal space of the base material which corresponds to an outside of a plurality of the through holes with respect to the width direction.

In the image forming apparatus in the third aspect, the fixing member is heated by the heating source to the specified target temperature (fixing temperature). A conveyed sheet is brought into pressure contact with the outer surface of the fixing member to fix an image onto the sheet. Once the fixing member is heated to the fixing temperature, ultra fine particles such as siloxanes (with a particle size of 100 nm or less) are generated from the rubber layer of the fixing member. In this case, the outer surface of the rubber layer is covered with the outer layer. The end portion of the rubber layer is also covered with the sealing section. Accordingly, in this image forming apparatus, the ultra fine particles generated from the rubber layer of the fixing member are likely to be emitted to an internal space of the base material through a plurality of the through holes provided in the base material and are further likely to move through the internal space of the base material along the width direction and come out of the base material. The ultra fine particles which are likely to come out of the base material are then trapped by the filter member provided in a region of the internal space of the base material which corresponds to the outside of a plurality of the through holes with respect to the width direction. As a result, the image forming apparatus can prevent contamination of the environment inside and around the apparatus.

It is to be noted that the gas pressure of the ultra fine particles (such as siloxanes) generated from the rubber layer is released to the internal space of the base material through a plurality of the through holes provided in the base material and is further released through the filter member. This makes it possible to prevent separation between the rubber layer and the outer layer.

An image forming apparatus according to a fourth aspect of the present invention comprises:

a cylindrical or annular fixing member, an outer surface of which is brought into pressure contact with a conveyed sheet to fix an image onto the sheet; and a heating source for heating the fixing member to a specified target temperature, wherein the fixing member includes three layers composed of: a cylindrical base material; a rubber layer provided so as to cover an outer surface of the base material and having elasticity to allow for a size of a region with which the sheet is put in pressure contact; and an outer layer provided so as to cover an outer surface of the rubber layer for aiding release of the sheet, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material, the image forming apparatus further comprising:

a duct which is fittingly attached to an end portion of the base material and which has an inlet for taking in ultra fine particles generated from the rubber layer through the through holes and an internal space of the base material;

an air flow generation section for generating an air current flowing from the inlet to an outlet of the duct; and a filter member provided inside the duct or in the outlet so as to be able to trap the ultra fine particles which ride on the air current and flow through the duct.

In the image forming apparatus in the fourth aspect, the fixing member is heated by the heating source to the specified target temperature (fixing temperature). A conveyed sheet is brought into pressure contact with the outer surface of the fixing member to fix an image onto the sheet. Once the fixing member is heated to the fixing temperature, ultra fine particles such as siloxanes (with a particle size of 100 nm or less) are generated from the rubber layer of the fixing member. In this case, the outer surface of the rubber layer is covered with the outer layer. The end portion of the rubber layer is also covered with the sealing section. Accordingly, in this image forming apparatus, the ultra fine particles generated from the rubber layer of the fixing member are likely to be emitted to an internal space of the base material through a plurality of the through holes provided in the base material and are further likely to move through the internal space of the base material along the width direction and come out of the base material. The ultra fine particles which are likely to come out of the base material are taken into the duct through the inlet fittingly attached to the end portion of the base material. The ultra fine particles taken into the duct ride on the air current generated by the air flow generation section and flow through the duct from the inlet to the outlet of the duct. The ultra fine particles which flow through the duct are trapped by the filter member provided inside the duct or in the outlet. As a result, the image forming apparatus can prevent contamination of the environment inside and around the apparatus.

It is to be noted that the gas pressure of the ultra fine particles (such as siloxanes) generated from the rubber layer is released to the internal space of the base material through a plurality of the through holes provided in the base material and is further released through the filter member and the duct. This makes it possible to prevent separation between the rubber layer and the outer layer.

In the image forming apparatus of one embodiment, some through holes out of a plurality of the through holes are provided in a position over the end portion of the rubber layer with respect to the width direction.

The ultra fine particles generated by the rubber layer may possibly push away the sealing section which covers the end portion of the rubber layer and emerge from the end portion of the rubber layer to the outside thereof. In this case, in the image forming apparatus of this one embodiment, some through holes out of a plurality of the through holes are provided in a position over the end portion of the rubber layer with respect to the width direction. Therefore, the ultra fine particles which are likely to be emitted from the end portion of the rubber layer to the outside of the rubber layer are smoothly emitted to the internal space of the base material through the some through holes provided over the end portion of the rubber layer. As a result, the sealing section which covers the end portion of the rubber layer is not damaged by the ultra fine particles which are likely to be emitted from the end portion of the rubber layer to the outside of the rubber layer.

If for instance, a closed space (clearance) were generated at the end portion of the rubber layer, repeated temperature increase and decrease in the fixing member may cause separation between the rubber layer and the outer layer due to a difference in expansion coefficient therebetween. In this regard, in the image forming apparatus of this one embodiment, some through holes out of a plurality of the through holes are provided in a position over the end portion of the rubber layer with respect to the width direction. This makes it possible to prevent separation between the rubber layer and the outer layer.

In the image forming apparatus of one embodiment, the end portion of the rubber layer is positioned inner than the end portion of the outer layer with respect to the width direction on the base material, and wherein a region on the outer surface of the base material which corresponds to the rubber layer is depressed in proportion to a thickness of the rubber layer so that the outer layer becomes flat with respect to the width direction.

In the image forming apparatus of this one embodiment, the outer layer becomes flat with respect to the width direction. Therefore, it becomes possible to sufficiently bring the end portion of the outer layer into close contact with the outer surface of the base material. As a result, the sealing section can be constituted of the end portion of the outer layer that is in close contact with the outer surface of the base material. In that case, the cost increase caused by taking a measure against ultra fine particles can be suppressed.

In the image forming apparatus of one embodiment, the sealing section comprises a sealant for sealing the end portion of the outer layer as well as the end portion of the rubber layer along the circumferential direction.

In the image forming apparatus of this one embodiment, the end portion of the rubber layer can reliably be covered with a sealant constituting the sealing section. Moreover, it is not necessary to apply special processing to the outer surface of the base material for forming any depression in proportion to the thickness of the rubber layer.

In the image forming apparatus of one embodiment, the sealant is made of a fluorine-based adhesive.

In the image forming apparatus of this one embodiment, the sealant is made of a fluorine-based adhesive, so that the sealant does not generate siloxanes and therefore does not become an emission source of ultra fine particles.

In the image forming apparatus of one embodiment, a plurality of the through holes are provided so as to be distributed throughout a region of the base materials corresponding to the rubber layer.

In the image forming apparatus of this one embodiment, the ultra fine particles generated from the rubber layer can easily be emitted to the internal space of the base material through a plurality of the through holes.

In the image forming apparatus of one embodiment, a plurality of the through holes are exclusively provided in a portion which is inside a region of the base material corresponding to the rubber layer and outside the region with which the sheet should be put in pressure contact, with respect to the width direction.

In the image forming apparatus of this one embodiment, the presence of a plurality of the through holes does not affect the temperature distribution of the region of the fixing member with which the sheet should be brought into pressure contact.

In the image forming apparatus of one embodiment, a diameter of each of the through holes is equal to or less than a thickness of the rubber layer.

In the image forming apparatus of this one embodiment, the diameter of each of the through holes is equal to or less than the thickness of the rubber layer, so that the heat from a portion of the base material around a certain through hole for example transmits with relative ease to the surface of a portion of the rubber layer which covers the through hole. Therefore, an influence exerted by the presence of a plurality of the through holes on the temperature distribution of the fixing member (temperature distribution of the outer layer) becomes relatively small. As a result, uneven temperature distribution can be reduced to the level which does not affect images.

In the image forming apparatus of one embodiment, an air current velocity in the internal space of the base material is 0.1 m/s or less.

In the image forming apparatus of this one embodiment, lowering of temperature in the fixing member becomes relatively small. Moreover, the efficiency of the filter member to trap the ultra fine particles is enhanced.

In the image forming apparatus of one embodiment, a filtering medium of the filter member contains carbon as a main component.

In the image forming apparatus of this one embodiment, since a filtering medium of the filter member contains carbon as a main component, it is easy to secure the heat tolerance of the filter member. Further, the filter member can be structured rather easily. Further, it becomes easy to secure the surface area of the filter member, as a result of which the ultra fine particles can be trapped over a relatively long period of time.

In the image forming apparatus of one embodiment, a filtering medium of the filter member contains polytetrafluoroethylene as a main component.

In the image forming apparatus of this one embodiment, since the filtering medium of the filter member contains polytetrafluoroethylene as a main component, it is easy to secure the heat tolerance of the filter member.

In the image forming apparatus of one embodiment, pressure loss characteristics of the filter member are ½ or less of pressure loss characteristics of the outer layer.

In the image forming apparatus of this one embodiment, ultra fine particle generated from the rubber layer are likely to pass the filter member rather than to transmit the outer layer. Therefore, it becomes easy to trap the ultra fine particles with the filter member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

a cylindrical or annular fixing member, an outer surface of which is brought into pressure contact with a conveyed sheet to fix an image onto the sheet;

a heating source for heating the fixing member to a specified target temperature, wherein the fixing member includes a cylindrical or annular base material; a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, and wherein a filter member capable of trapping ultra fine particles generated from the rubber layer is provided on the base material in a position facing the end portion of the rubber layer along the circumferential direction, wherein the filter member is in direct contact with the end portion of the rubber layer and with the end portion of the outer layer to cover the end portion of the rubber layer; and a spring member provided on the base material in a position closer to the end portion of the base material than the filter member with respect to the width direction for biasing the filter member toward the end portion of the rubber layer.

2. An image forming apparatus, comprising:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical or annular base material; a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, the image forming apparatus further comprising:

a duct provided around the base material in a position facing the end portion of the rubber layer along the circumferential direction, and having an inlet for taking in ultra fine particles generated from the end portion of the rubber layer;

an air flow generation section for generating an air current flowing from the inlet to an outlet of the duct; and a filter member provided inside the duct or in the outlet so as to be able to trap the ultra fine particles which ride on the air current and flow through the duct, wherein the inlet of the duct has a first sidewall positioned closer to the end portion of the base material than the end portion of the rubber layer with respect to the width direction on the base material, and a second sidewall positioned farther from the end portion of the base material than the end portion of the rubber layer, and wherein an inner peripheral edge of the first sidewall is distanced from the outer surface of the base material, while an inner peripheral edge of the second sidewall is in contact with the outer layer.

3. The image forming apparatus as claimed in claim 2, wherein a first sidewall facing section on the outer surface of the base material which faces the first sidewall of the duct is covered with a sleeve which is distanced from the inner peripheral edge of the first sidewall and which has heat insulation properties.

4. The image forming apparatus as claimed in claim 2, wherein a sealing member having heat insulation properties is attached to the inner peripheral edge of the second sidewall, and wherein the inner peripheral edge of the second sidewall is in contact with a second sidewall facing section on the outer surface of the outer layer via the sealing member.

5. The image forming apparatus as claimed in any one of claims 2, wherein the air flow generation section comprises an exhaust fan provided inside the duct or in the outlet.

6. The image forming apparatus as claimed in any one of claims 2, wherein the duct extends upward from the inlet to the outlet, and wherein the air flow generation section comprises the fixing member which is heated to the specified target temperature for fixing operation and generates an ascending air current.

7. The image forming apparatus as claimed in claim 2, comprising:

a pressure member circumscribed with the fixing member to form a nip section so that the sheet is brought into pressure contact with the outer surface of the fixing member, wherein the pressure member is substantially equal in size to the fixing member with respect to the width direction, and wherein the inlet of the duct collectively surrounds and covers all circumferences of the end portion of the rubber layer in the fixing member and a portion of the pressure member corresponding to the end portion of the rubber layer.

8. An image forming apparatus comprising:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical or annular base material; a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than an end portion of the base material with respect to a width direction perpendicular to a circumferential direction on the base material, the image forming apparatus further comprising:

a duct provided around the base material in a position facing the end portion of the rubber layer along the circumferential direction, and having an inlet for taking in ultra fine particles generated from the end portion of the rubber layer;

an air flow generation section for generating an air current flowing from the inlet to an outlet of the duct;

a filter member provided inside the duct or in the outlet so as to be able to trap the ultra fine particles which ride on the air current and flow through the duct; and a pressure member circumscribed with the fixing member to form a nip section so that the sheet is brought into pressure contact with the outer surface of the fixing member, wherein the pressure member is larger in size than the sheet and is smaller in size than the rubber layer and the outer layer with respect to the width direction, and wherein the inlet of the duct surrounds and covers all circumferences of the end portions of the rubber layer and the outer layer of the fixing member.

9. An image forming apparatus, comprising:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical base material, a rubber layer provided so as to cover an outer surface of the base material and having elasticity, and an outer layer provided so as to cover an outer surface of the rubber layer for aiding release of the sheet, wherein an end portion of the rubber layer and an end portion of the outer layer are each positioned inner than the an end portion of the base material with respect to a width direction perpendicular to a circumferential direction on the base material, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material; and wherein a filter member capable of trapping ultra fine particles generated from the rubber layer is provided in a region of an internal space of the base material which corresponds to an outside of a plurality of the through holes with respect to the width direction.

10. The image forming apparatus as claimed in claim 9, wherein some through holes out of a plurality of the through holes are provided in a position over the end portion of the rubber layer with respect to the width direction.

11. The image forming apparatus as claimed in claim 9, wherein the end portion of the rubber layer is positioned inner than the end portion of the outer layer with respect to the width direction on the base material, and wherein a region on the outer surface of the base material which corresponds to the rubber layer is depressed in proportion to a thickness of the rubber layer so that the outer layer becomes flat with respect to the width direction.

12. The image forming apparatus as claimed in claim 9, wherein the sealing section comprises a sealant for sealing the end portion of the outer layer as well as the end portion of the rubber layer along the circumferential direction.

13. The image forming apparatus as claimed in claim 9, wherein a plurality of the through holes are provided so as to be distributed throughout a region of the base materials corresponding to the rubber layer.

14. The image forming apparatus as claimed in claim 9, wherein a plurality of the through holes are exclusively provided in a portion which is inside a region of the base material corresponding to the rubber layer and outside the region with which the sheet should be put in pressure contact, with respect to the width direction.

15. An image forming apparatus comprising:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical base material, a rubber layer provided so as to cover an outer surface of the base material and having elasticity; and an outer layer provided so as to cover an outer surface of the rubber layer for aiding release of the sheet, wherein an end portion of the rubber layer and an end portion of the outer layer are each positioned inner than the an end portion of the base material with respect to a width direction perpendicular to a circumferential direction on the base material, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material; and wherein a filter member capable of trapping ultra fine particles generated from the rubber layer is provided in a region of an internal space of the base material which corresponds to an outside of a plurality of the through holes with respect to the width direction, wherein a diameter of each of the through holes is equal to or less than a thickness of the rubber layer.

16. An image forming apparatus, comprising:

a cylindrical or annular fixing member, an outer surface of which is brought into pressure contact with a conveyed sheet to fix an image onto the sheet; and a heating source for heating the fixing member to a specified target temperature, wherein the fixing member includes a cylindrical base material, a rubber layer provided so as to cover an outer surface of the base material and having elasticity, and an outer layer provided so as to cover an outer surface of the rubber layer for aiding release of the sheet, wherein a sealing section is provided on the base material for covering the end portion of the rubber layer, wherein the base material has a plurality of through holes provided in a region corresponding to the rubber layer with respect to the width direction, the through holes passing through the outer surface and an inner surface of the base material, the image forming apparatus further comprising:

a duct which is fittingly attached to an end portion of the base material and which has an inlet for taking in ultra fine particles generated from the rubber layer through the through holes and an internal space of the base material;

an air flow generation section for generating an air current flowing from the inlet to an outlet of the duct; and a filter member provided inside the duct or in the outlet so as to be able to trap the ultra fine particles which ride on the air current and flow through the duct.

* * * * *